US011286919B2

(12) United States Patent
Song

(10) Patent No.: US 11,286,919 B2
(45) Date of Patent: Mar. 29, 2022

(54) VARIABLE DISPLACEMENT SWASH PLATE TYPE COMPRESSOR

(71) Applicant: Hanon Systems, Daejeon (KR)

(72) Inventor: Se Young Song, Daejeon (KR)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 16/979,273

(22) PCT Filed: Jul. 19, 2019

(86) PCT No.: PCT/KR2019/008921
§ 371 (c)(1),
(2) Date: Sep. 9, 2020

(87) PCT Pub. No.: WO2020/017917
PCT Pub. Date: Jan. 23, 2020

(65) Prior Publication Data

US 2021/0140419 A1 May 13, 2021

(30) Foreign Application Priority Data

Jul. 19, 2018 (KR) ..... 10-2018-0084072

(51) Int. Cl.
*F04B 27/18* (2006.01)
*F04B 27/10* (2006.01)

(52) U.S. Cl.
CPC ..... *F04B 27/1804* (2013.01); *F04B 27/109* (2013.01); *F04B 27/1081* (2013.01);
(Continued)

(58) Field of Classification Search
CPC ..... F04B 27/1081; F04B 27/109; F04B 27/1804; F04B 2027/1813;
(Continued)

(56) References Cited

U.S. PATENT DOCUMENTS 3,503,417 A * 3/1970 Toda ..... F16K 17/0433 137/480
6,293,117 B1 * 9/2001 Ban ..... B60H 1/3225 62/228.3

(Continued)

FOREIGN PATENT DOCUMENTS

KR 10-2015-0005762 A 1/2015
KR 20150005762 A * 1/2015

(Continued)

OTHER PUBLICATIONS

International Search Report issued in PCT/KR2019/008921 dated Nov. 5, 2019.

*Primary Examiner* — Devon C Kramer
*Assistant Examiner* — Joseph S. Herrmann
(74) *Attorney, Agent, or Firm* — Norton Rose Fulbright US LLP; James R. Crawford

(57) ABSTRACT

Variable displacement swash plate type compressor includes casing, rotating shaft, swash plate, piston, and inclination adjustment mechanism with first flow path connecting discharge chamber with crankcase and second flow path connecting crankcase with suction chamber to adjust inclination angle of the swash plate. An orifice hole decompressing fluid passing through the second flow path is formed in the second flow path. An orifice control mechanism controlling effective flow cross-sectional area of the orifice hole is formed on the second flow path. The orifice hole and control mechanism are formed to increase differential pressure in the crankcase and suction chamber, the effective flow cross-sectional area increases, and with further differential pressure increase it becomes a second area larger than zero and less than the first area. Achieved is rapid control of refrigerant discharge amount and prevention of reduction in
(Continued)

compressor efficiency with reduction of time to switch to the maximum mode.

11 Claims, 11 Drawing Sheets

(52) U.S. Cl.
CPC ..... *F04B 2027/1813* (2013.01); *F04B 2027/1827* (2013.01); *F04B 2027/1831* (2013.01)

(58) Field of Classification Search
CPC ..... F04B 2027/1827; F04B 2027/1831; F16K 15/026
USPC ..... 137/504
See application file for complete search history.

(56) References Cited

U.S. PATENT DOCUMENTS

| | | | | |
|---|---|---|---|---|
| 8,869,826 | B2 * | 10/2014 | Chappel | G05D 7/0133 137/504 |
| 2004/0120829 | A1 | 6/2004 | Pitla et al. | |
| 2020/0370546 | A1 * | 11/2020 | Morita | F04B 27/1804 |

FOREIGN PATENT DOCUMENTS

| | | | |
|---|---|---|---|
| KR | 10-2016-0041128 | A | 4/2016 |
| KR | 10-2017-0110428 | A | 10/2017 |
| WO | 2004/061304 | A1 | 7/2004 |

* cited by examiner

CONVENTIONAL ART

VARIABLE DISPLACEMENT SWASH PLATE TYPE COMPRESSOR

CROSS REFERENCE TO RELATED APPLICATIONS

This patent application is a national phase under 35 U.S.C. § 371 of International Patent Application No. PCT/KR2019/008921 filed Jul. 19, 2019, which claims the benefit of priority from Korean patent application No. 10-2018-0084072 filed Jul. 19, 2018, each of which is hereby incorporated herein by reference in its entirety for all purposes.

BACKGROUND

Field

The present disclosure relates to a variable displacement swash plate type compressor and more particularly to a variable displacement swash plate type compressor which controls the pressure of a crankcase equipped with a swash plate and adjusts an inclination angle of the swash plate.

Description of the Related Art

In general, a compressor functioning to compress the refrigerant in a vehicle cooling system has been developed in various types. In such a compressor, a configuration for compressing the refrigerant includes a reciprocating type for compressing the refrigerant while performing a reciprocating motion and a rotation type for compressing the refrigerant while performing a rotational motion.

Also, the reciprocating type includes a crank type for transmitting a driving force of a driving source to a plurality of pistons by using a crank, a swash plate type for transmitting a driving force of a driving source to a rotating shaft with the swash plate installed therein, and a wobble plate type using a wobble plate. The rotation type includes a vane rotary type using a rotating shaft and a vane, and a scroll type using an orbiting scroll and a fixed scroll.

Here, the swash plate type compressor has a swash plate rotating together with the rotating shaft and compresses the refrigerant by reciprocating a piston. Recently, for the purpose of improvement of the performance and efficiency of the compressor, the swash plate type compressor is formed in a so-called variable displacement type which controls the refrigerant discharge amount by controlling the stroke of the piston through the adjustment of the inclination angle of the swash plate.

FIG. 1 is a perspective view showing a conventional variable displacement swash plate type compressor of which a portion is cut away to show the internal structure thereof.

Referring to the attached FIG. 1 the conventional variable displacement swash plate type compressor includes: a casing 100 which has a bore 114, a suction chamber S1, a discharge chamber S3, and a crankcase S4, a rotating shaft 210 which is supported rotatably on the casing 100, a swash plate 220 which is rotated within the crankcase S4 in conjunction with the rotating shaft 210, a piston 230 which reciprocates within the bore 114 in conjunction with the swash plate 220 and forms, together with the bore 114, a compression chamber, a valve mechanism 300 which communicates and shields the suction chamber S1 and the discharge chamber S3 with and from the compression chamber, and an inclination adjustment mechanism 400 which adjusts an inclination angle of the swash plate 220 with respect to the rotating shaft 210.

The inclination adjustment mechanism 400 includes a first flow path 430 which communicates the discharge chamber S3 with the crankcase S4, and a second flow path 450 which communicates the crankcase S4 with the suction chamber S1.

A pressure control valve (not shown) that opens and closes the first flow path 430 is formed on the first flow path 430.

An orifice hole 460 that decompresses a fluid passing through the second flow path 450 is formed in the second flow path 450.

In the conventional variable displacement swash plate type compressor according to such a configuration, when the power is transmitted from a driving source (e.g., an engine of a vehicle) (not shown) to the rotating shaft 210, the rotating shaft 210 and the swash plate 220 rotate together.

The piston 230 reciprocates within the bore 114 by converting the rotational motion of the swash plate 220 into a linear motion.

Also, when the piston 230 moves from the top dead center to the bottom dead center, the compression chamber communicates with the suction chamber S1 by the valve mechanism 300 and is shielded from the discharge chamber S3, so that the refrigerant in the suction chamber S1 is sucked into the compression chamber.

Also, when the piston 230 moves from the bottom dead center to the top dead center, the compression chamber is shielded from the suction chamber S1 and the discharge chamber S3 by the valve mechanism 300, and the refrigerant in the compression chamber is compressed.

Also, when the piston 230 reaches the top dead center, the compression chamber is shielded from the suction chamber S1 by the valve mechanism 300 and communicates with the discharge chamber S3, so that the refrigerant compressed in the compression chamber is discharged to the discharge chamber S3.

Here, the refrigerant discharge amount of the conventional variable displacement swash plate type compressor is controlled as follow.

First, when the compressor is stopped, the compressor is set to a minimum mode in which the refrigerant discharge amount is minimum. That is, the swash plate 220 is disposed close to perpendicular to the rotating shaft 210, and an inclination angle of the swash plate 220 is close to zero. Here, the inclination angle of the swash plate 220 is measured as an angle between the rotating shaft 210 of the swash plate 220 and a normal of the swash plate 220, based on the center of rotation of the swash plate 220.

Next, when the operation of the compressor starts, the compressor is adjusted to a maximum mode in which the refrigerant discharge amount is maximum. That is, the first flow path 430 is closed by the pressure control valve (not shown), and the refrigerant in the crankcase S4 flows into the suction chamber S1 through the second flow path 450, so that the pressure in the crankcase S4 is reduced to the level of the suction pressure (the pressure in the suction chamber S1). Accordingly, the pressure in the crankcase S4 applied to the piston 230 is reduced to the minimum degree, and the stroke of the piston 230 is increased to the maximum degree. Then, the inclination angle of the swash plate 220 is increased to the maximum degree, and the refrigerant discharge amount is increased to the maximum degree.

Here, describing the principle of controlling the refrigerant discharge amount, the piston 230 forms the inclination angle of the swash plate as a moment difference due to a differential pressure obtained by subtracting the pressure in the crankcase S4 from the pressure in the compression chamber mainly applied to the piston 230. The lower the pressure in the crankcase S4, the more the inclination angle of the swash plate 220 increases and the more the stroke of the piston 230 increases and the more the refrigerant discharge amount increases. On the other hand, the greater the pressure in the crankcase S4, the more the inclination angle of the swash plate 220 decreases and the more the stroke of the piston 230 decreases and the more the refrigerant discharge amount decreases.

Next, after the maximum mode, based on the required refrigerant discharge amount, the opening amount of the first flow path 430 is controlled by the pressure control valve (not shown), so that the pressure in the crankcase S4 is controlled. Accordingly, the pressure in the crankcase S4 applied to the piston 230 is controlled, so that the stroke of the piston 230 is adjusted, the inclination angle of the swash plate 220 is adjusted, and the refrigerant discharge amount is adjusted.

That is, for example, when the refrigerant discharge amount is required to be decreased after being increased to the maximum degree, the first flow path 430 is opened by the pressure control valve (not shown), and the opening amount of the first flow path 430 is increased by the pressure control valve (not shown), so that the pressure in the crankcase S4 is increased. Here, though the refrigerant in the crankcase S4 is discharged to the suction chamber S1 through the second flow path 450, the amount of the refrigerant which is introduced from the discharge chamber S3 into the suction chamber S1 through the first flow path 430 is greater than the amount of the refrigerant which is discharged from the crankcase S4 to the suction chamber S1 through the second flow path 450, so that the pressure in the crankcase S4 is increased. Accordingly, the pressure in the crankcase S4 applied to the piston 230 is increased, so that the stroke of the piston 230 is reduced, the inclination angle of the swash plate 220 is reduced, and the refrigerant discharge amount is reduced.

As another example, when the refrigerant discharge amount is required to be increased after being decreased, the first flow path 430 is opened by the pressure control valve (not shown), and the opening amount of the first flow path 430 is decreased by the pressure control valve (not shown), so that the pressure in the crankcase S4 is decreased. Here, though the refrigerant in the discharge chamber S3 is introduced into the suction chamber S1 through the first flow path 430, the amount of the refrigerant which is discharged from the crankcase S4 into the suction chamber S1 through the second flow path 450 is greater than the amount of the refrigerant which is introduced from the discharge chamber S3 into the suction chamber S1 through the first flow path 430, so that the pressure in the crankcase S4 is decreased. Accordingly, the pressure in the crankcase S4 applied to the piston 230 is decreased, so that the stroke of the piston 230 is increased, the inclination angle of the swash plate 220 is increased, and the refrigerant discharge amount is increased.

Meanwhile, here, when the refrigerant in the crankcase S4 flows to the suction chamber S1 through the second flow path 450, the refrigerant is decompressed to the level of the suction pressure by the orifice hole 460, thereby preventing the pressure in the suction chamber S1 from increasing.

However, in such a conventional swash plate type compressor, there is a problem that rapid control of the refrigerant discharge amount and the prevention of reduction in compressor efficiency cannot be achieved at the same time.

Specifically, as described above, in order to increase the refrigerant discharge amount through the reduction of the pressure in the crankcase S4, the crankcase S4 is in communication with the suction chamber S1 through the second flow path 450. Also, in general, in order to improve the responsiveness of the increase in the refrigerant discharge amount, the cross-sectional area of the orifice hole 460 of the second flow path 450 is formed as large as possible. That is, the refrigerant in the crankcase S4 is quickly discharged to the suction chamber S1, so that the pressure in the crankcase S4 is rapidly reduced, the stroke of the piston 230 is rapidly increased, and the inclination angle of the swash plate 220 is rapidly increased. Therefore, for the purpose that the refrigerant discharge amount is rapidly increased, the orifice hole 460 is formed as a fixed orifice hole, and the cross-sectional area of the orifice hole 460 is formed maximally within a range in which the refrigerant passing through the second flow path 450 is sufficiently decompressed. However, when the cross-sectional area of the orifice hole 460 is formed as large as possible, a large amount of the refrigerant leaks from the crankcase S4 to the suction chamber S1. Accordingly, in the minimum mode or in a variable mode (a mode in which the refrigerant discharge amount is increased, maintained or decreased between the minimum mode and the maximum mode), in order to adjust the pressure in the crankcase S4 to a desired level, the amount of the refrigerant which is introduced from the discharge chamber S3 into the crankcase S4 through the first flow path 430 should be increased more than that of when the cross-sectional area of the orifice hole 460 is formed relatively small. As a result of this, the amount of the refrigerant which is discharged at a cooling cycle among the compressed refrigerant is reduced. Therefore, in order to achieve a desired cooling or heating level, the power input to the compressor must be increased such that the compressor compresses more refrigerant, and thus, the efficiency of the compressor is reduced.

Also, the conventional swash plate type compressor has a problem in that the time required to switch to the maximum mode is increased.

SUMMARY

Technical Problem

Accordingly, the purpose of the present disclosure is to provide a variable displacement swash plate type compressor capable of achieving rapid control of the refrigerant discharge amount and the prevention of reduction in compressor efficiency at the same time.

Also, another purpose of the present disclosure is to provide a variable displacement swash plate type compressor capable of reducing the time required to switch to the maximum mode.

Technical Solution

One embodiment is a variable displacement swash plate type compressor including: a casing which has a bore, a suction chamber, a discharge chamber, and a crankcase; a rotating shaft which is supported rotatably on the casing; a swash plate which is rotated within the crankcase in conjunction with the rotating shaft; a piston which reciprocates within the bore in conjunction with the swash plate and forms, together with the bore, a compression chamber; and an inclination adjustment mechanism which has a first flow path which communicates the discharge chamber with the crankcase and a second flow path which communicates the crankcase with the suction chamber, in order to adjust an inclination angle of the swash plate with respect to the rotating shaft. An orifice hole which decompresses a fluid passing through the second flow path is formed in the second flow path. An orifice control mechanism which controls an effective flow cross-sectional area of the orifice hole is formed on the second flow path. The orifice hole and the orifice control mechanism are formed such that when a differential pressure between a pressure in the crankcase and a pressure in the suction chamber is increased, the effective flow cross-sectional area changes from zero to a first area that is larger than zero and when the differential pressure is further increased, the effective flow cross-sectional area becomes a second area that is larger than zero and less than the first area.

The orifice hole may include: a first orifice hole which is in communication with the crankcase; a third orifice hole which is in communication with the suction chamber; and a second orifice hole which is formed between the first orifice hole and the third orifice hole. The orifice control mechanism may include: a valve chamber which is in communication with the first orifice hole and the second orifice hole; and a valve core which reciprocates along the valve chamber and controls an opening amount of the first orifice hole, an opening amount of the second orifice hole, and an opening amount of the third orifice hole The orifice hole and the orifice control mechanism may be formed such that, when the differential pressure is less than a first pressure, the effective flow cross-sectional area becomes zero, when the differential pressure is greater than or equal to the first pressure and less than a second pressure, the effective flow cross-sectional area becomes the first area, and when the differential pressure is greater than or equal to the second pressure, the effective flow cross-sectional area becomes the second area.

The valve chamber may include: a valve chamber inner circumferential surface which guides the reciprocating motion of the valve core; a valve chamber first front end surface which is located at one end side of the valve chamber inner circumferential surface; and a valve chamber second front end surface which is located at the other end side of the valve chamber inner circumferential surface. The first orifice hole may be in communication with the valve chamber at the valve chamber first front end surface. The second orifice hole 464 may be in communication with the valve chamber at the valve chamber second front end surface. The third orifice hole may be in communication with the second orifice hole at a position facing the valve chamber, so that the first orifice hole, the valve chamber, the second orifice hole, and the third orifice hole are formed sequentially according to a direction of the reciprocating motion of the valve core.

The valve core may include: a first end which reciprocates within the valve chamber and controls the opening amount of the first orifice hole; and a second end which extends from the first end and reciprocates together with the first end, and controls the opening amounts of the second orifice hole and the third orifice hole The first end may include: a first cylindrical portion which comprises an outer circumferential surface facing the valve chamber inner circumferential surface, a bottom surface facing the second orifice hole, and an upper surface facing the third orifice hole; a second cylindrical portion which extends from the upper surface of the first cylindrical portion to the second orifice hole 464 side and forms a concentric circle with the first cylindrical portion; and a plurality of protrusions which are formed radially from the outer circumferential surface of the first cylindrical portion and the outer circumferential surface of the second cylindrical portion with respect to central axes of the first cylindrical portion and the second cylindrical portion. The second end may include a third cylindrical portion which further extends from the second cylindrical portion to the second orifice hole side and forms a concentric circle with the second cylindrical portion An outer diameter of the first cylindrical portion may be formed to be less than an outer diameter of the plurality of protrusions. An outer diameter of the second cylindrical portion may be formed to be less than the outer diameter of the first cylindrical portion. An outer diameter of the third cylindrical portion may be formed at an equal level to the outer diameter of the second cylindrical portion. An inner diameter of the valve chamber may be formed at an equal level to the outer diameter of the plurality of protrusions. An inner diameter of the first orifice hole may be formed to be less than the outer diameter of the first cylindrical portion. An inner diameter of the second orifice hole may be formed to be larger than the outer diameter of the third cylindrical portion and may be formed to be less than the outer diameter of the plurality of protrusions. An inner diameter of the third orifice hole may be formed to be larger than the outer diameter of the third cylindrical portion and may be formed to be less than the inner diameter of the second orifice hole.

A length of the plurality of protrusions may be formed to be less than a length of the valve chamber. A length obtained by adding a length of the first cylindrical portion and a length of the second cylindrical portion may be formed at an equal level to the length of the plurality of protrusions. A length of the third cylindrical portion may be formed to be larger than a length of the second orifice hole and may be formed to be less than a length obtained by adding the length of the second orifice hole 464 and a length of the third orifice hole. A length obtained by adding the length of the plurality of protrusions and the length of the third cylindrical portion may be formed to be larger than the length of the valve chamber and may be formed to be less than a length obtained by adding the length of the valve chamber and the length of the second orifice hole.

An area obtained by subtracting an area of the third cylindrical portion from a cross-sectional area of the second orifice hole may be formed as the first area. An area obtained by subtracting the area of the third cylindrical portion from a cross-sectional area of the third orifice hole may be formed as the second area. A cross-sectional area of the first orifice hole may be formed to be equal to or greater than the first area.

An area obtained by subtracting an area of the first cylindrical portion and an area of the plurality of protrusions from a cross-sectional area of the valve chamber may be formed to be equal to or greater than the cross-sectional area of the first orifice hole.

The orifice control mechanism may further include an elastic member which presses the valve core toward the valve chamber first front end surface.

The casing may include: a cylinder block in which the bore is formed; a front housing which is coupled to one side of the cylinder block and in which the crankcase is formed; and a rear housing which is coupled to the other side of the cylinder block and in which the suction chamber and the discharge chamber are formed. A valve mechanism which communicates and shields the suction chamber and the discharge chamber with and from the compression chamber may be interposed between the cylinder block and the rear housing. The rear housing 130 may include a post portion 132 which extends from an inner wall surface of the rear housing 130 and is supported by the valve mechanism in order to prevent deformation of the rear housing 130. The first orifice hole 462 may be formed in the valve mechanism. The valve chamber 472, the second orifice hole 464, and the third orifice hole 466 may be formed in the post portion The orifice hole and the orifice control mechanism may be formed such that the effective flow cross-sectional area becomes zero when the compressor is stopped.

Advantageous Effects

A variable displacement swash plate compressor according to the present disclosure includes: a casing which has a bore, a suction chamber, a discharge chamber, and a crankcase; a rotating shaft which is supported rotatably on the casing; a swash plate which is rotated within the crankcase in conjunction with the rotating shaft; a piston which reciprocates within the bore in conjunction with the swash plate and forms, together with the bore, a compression chamber; and an inclination adjustment mechanism which has a first flow path which communicates the discharge chamber with the crankcase and a second flow path which communicates the crankcase with the suction chamber, in order to adjust an inclination angle of the swash plate with respect to the rotating shaft. An orifice hole which decompresses a fluid passing through the second flow path is formed in the second flow path. An orifice control mechanism which controls an effective flow cross-sectional area of the orifice hole is formed on the second flow path. The orifice hole and the orifice control mechanism are formed such that when a differential pressure between a pressure in the crankcase and a pressure in the suction chamber is increased, the effective flow cross-sectional area changes from zero to a first area that is larger than zero and when the differential pressure is further increased, the effective flow cross-sectional area becomes a second area that is larger than zero and less than the first area. As a result of this, it is possible to achieve rapid control of the refrigerant discharge amount and the prevention of reduction in compressor efficiency at the same time.

Also, the time required to switch to the maximum mode can be reduced.

DETAILED DESCRIPTION

Hereinafter, a variable displacement swash plate type compressor according to the present disclosure will be described in detail with reference to the accompanying drawings.

Figure 2:
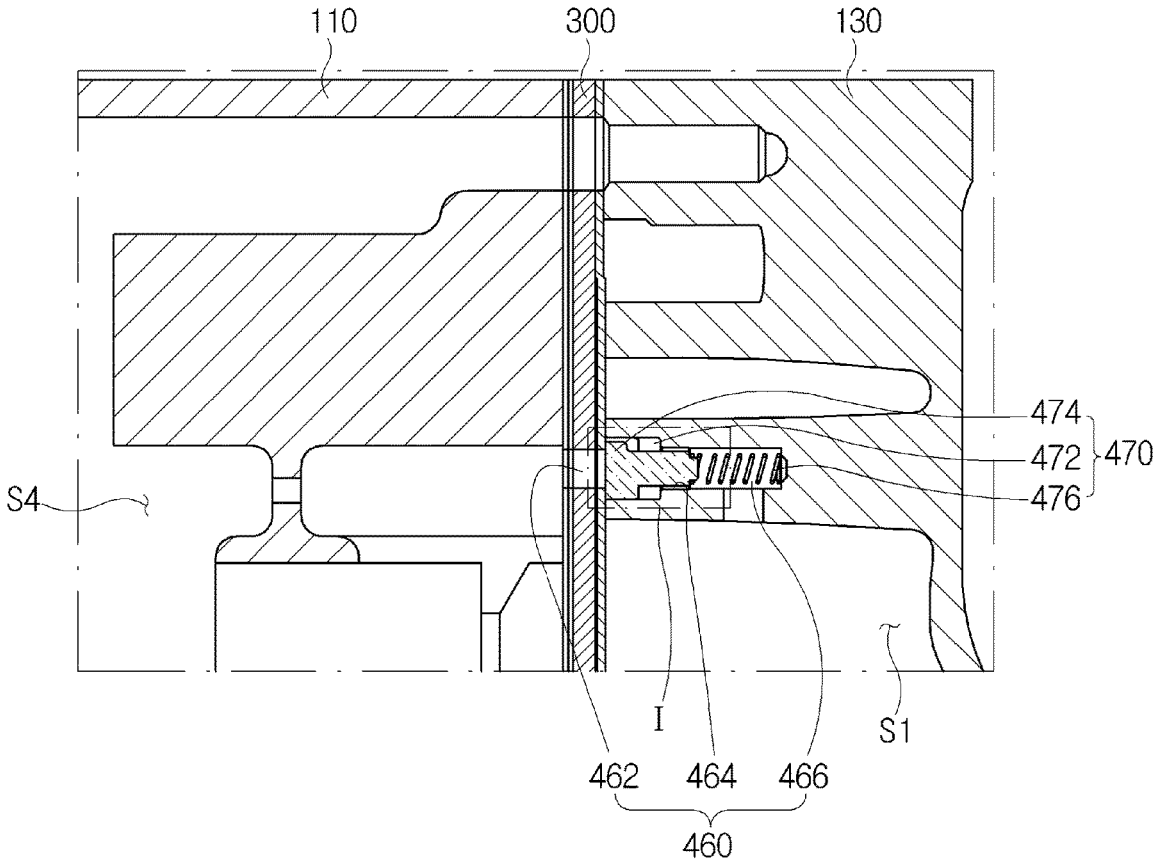
FIG. 2 is a cross-sectional view showing a second flow path in a variable displacement swash plate type compressor according to an embodiment of the present disclosure.
Figure 3:
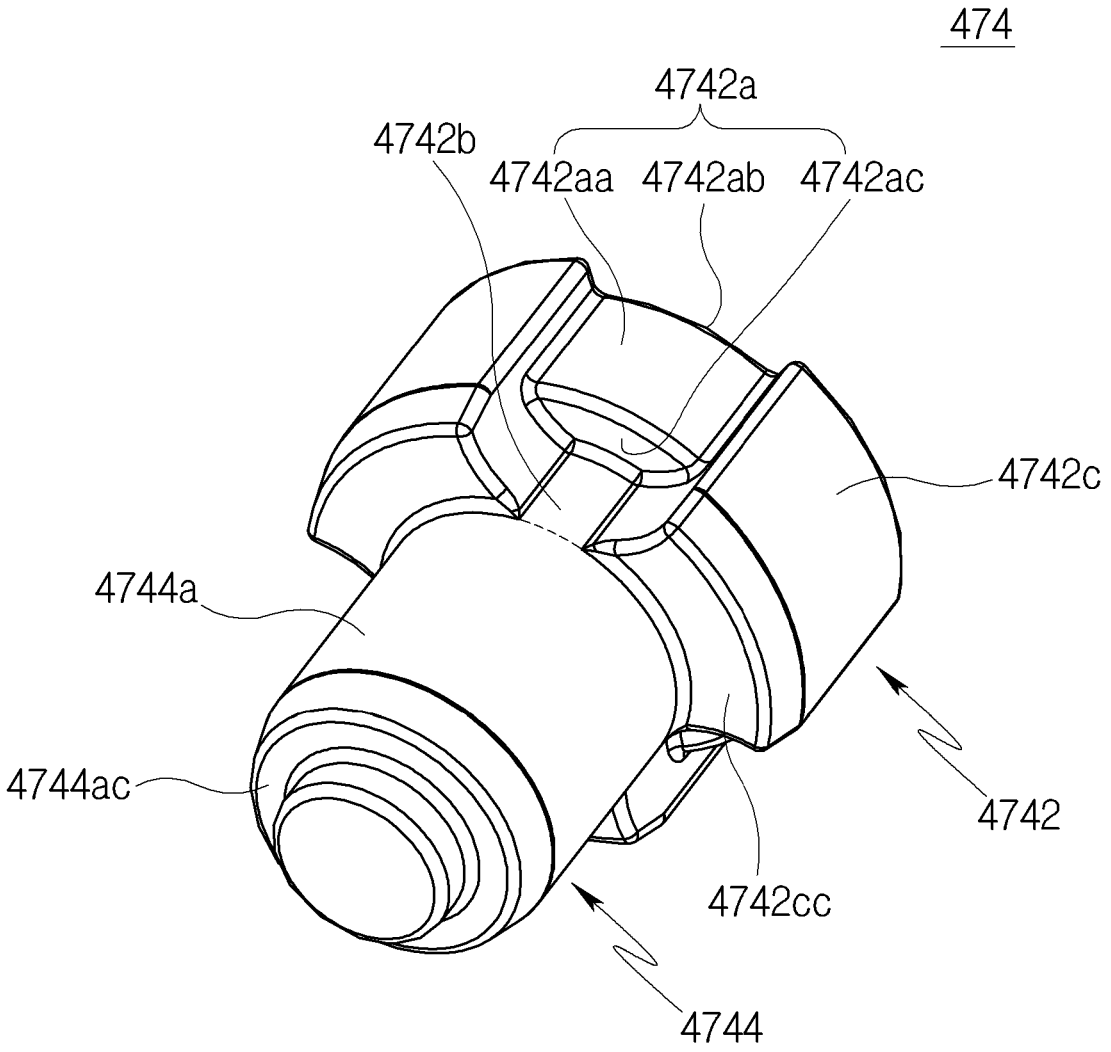
FIG. 3 is a perspective view of a valve core of FIG. 2 when viewed from one side.
Figure 4:
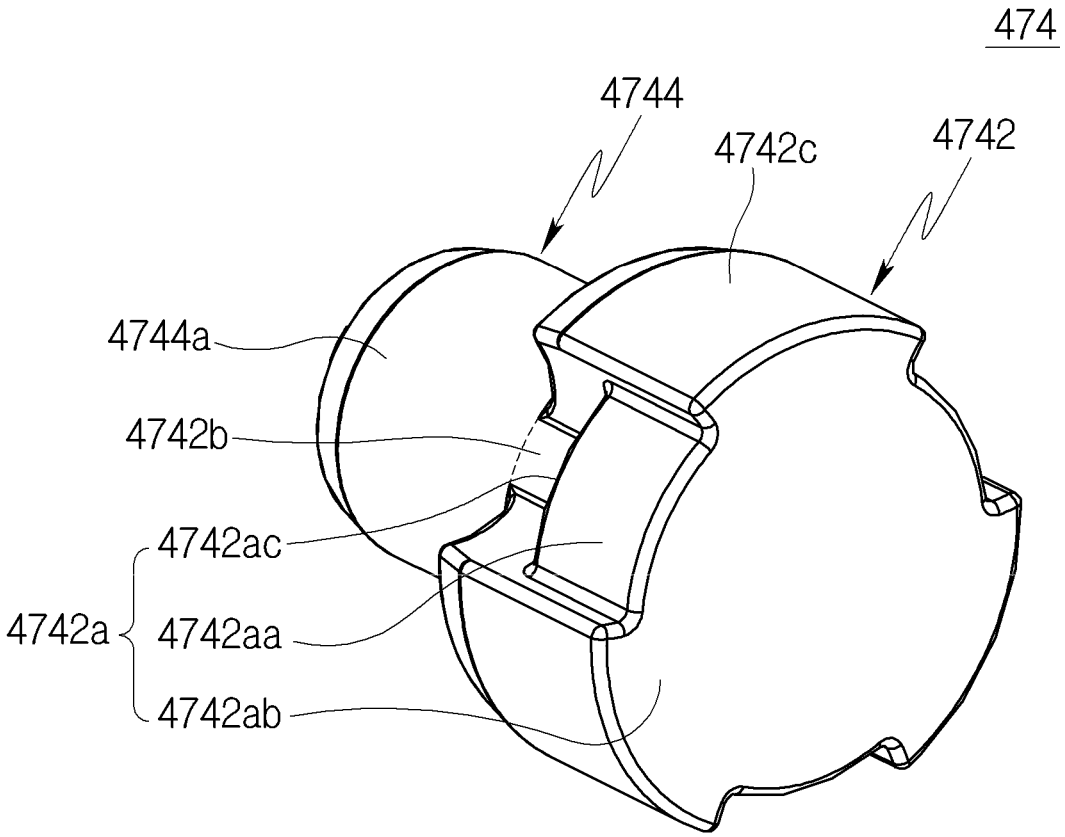
FIG. 4 is a perspective view of the valve core of FIG. 2 when viewed from the other side.
Figure 5:
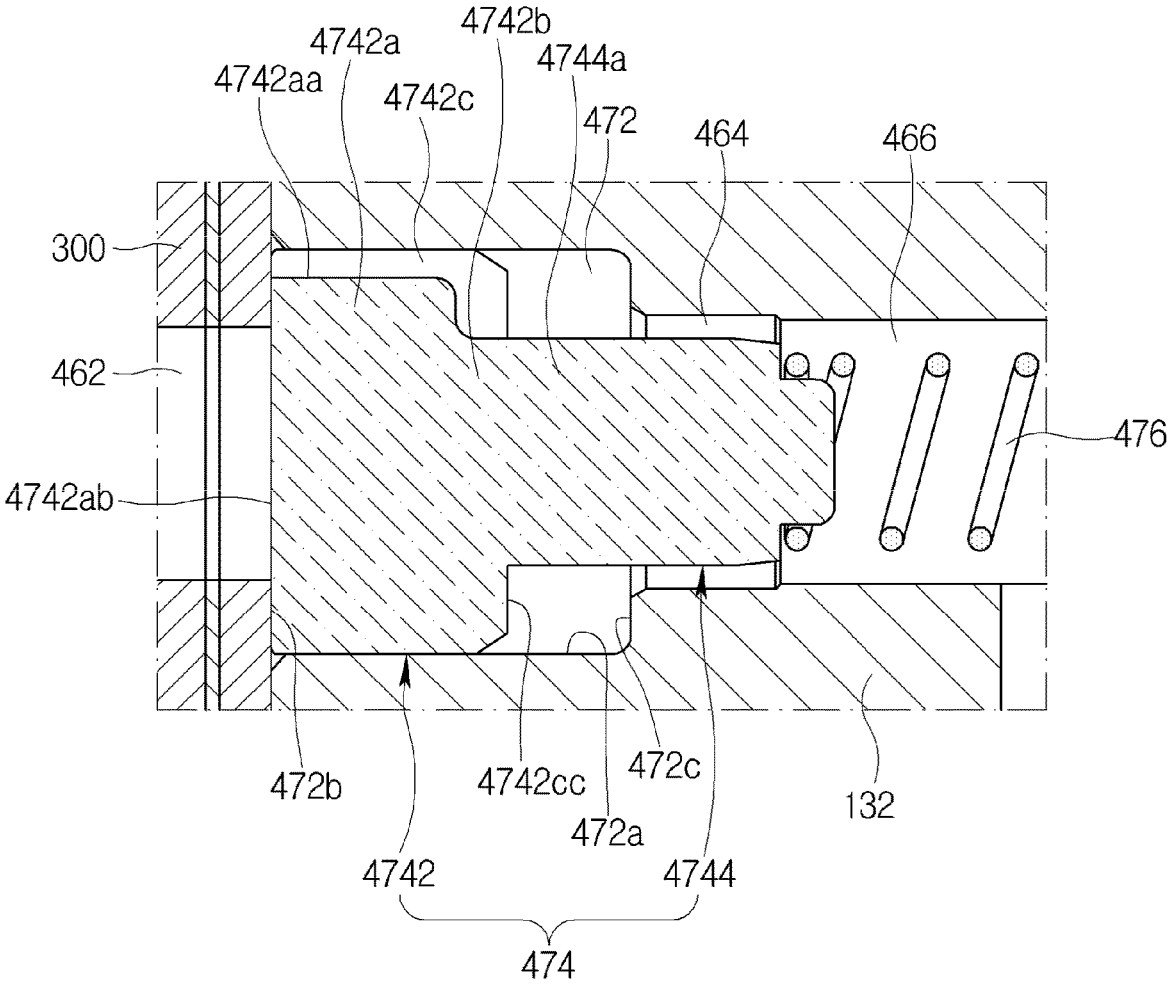
FIG. 5 is an enlarged cross-sectional view of a part "I" of FIG. 2 and shows that a differential pressure is less than a first pressure.
Figure 6:
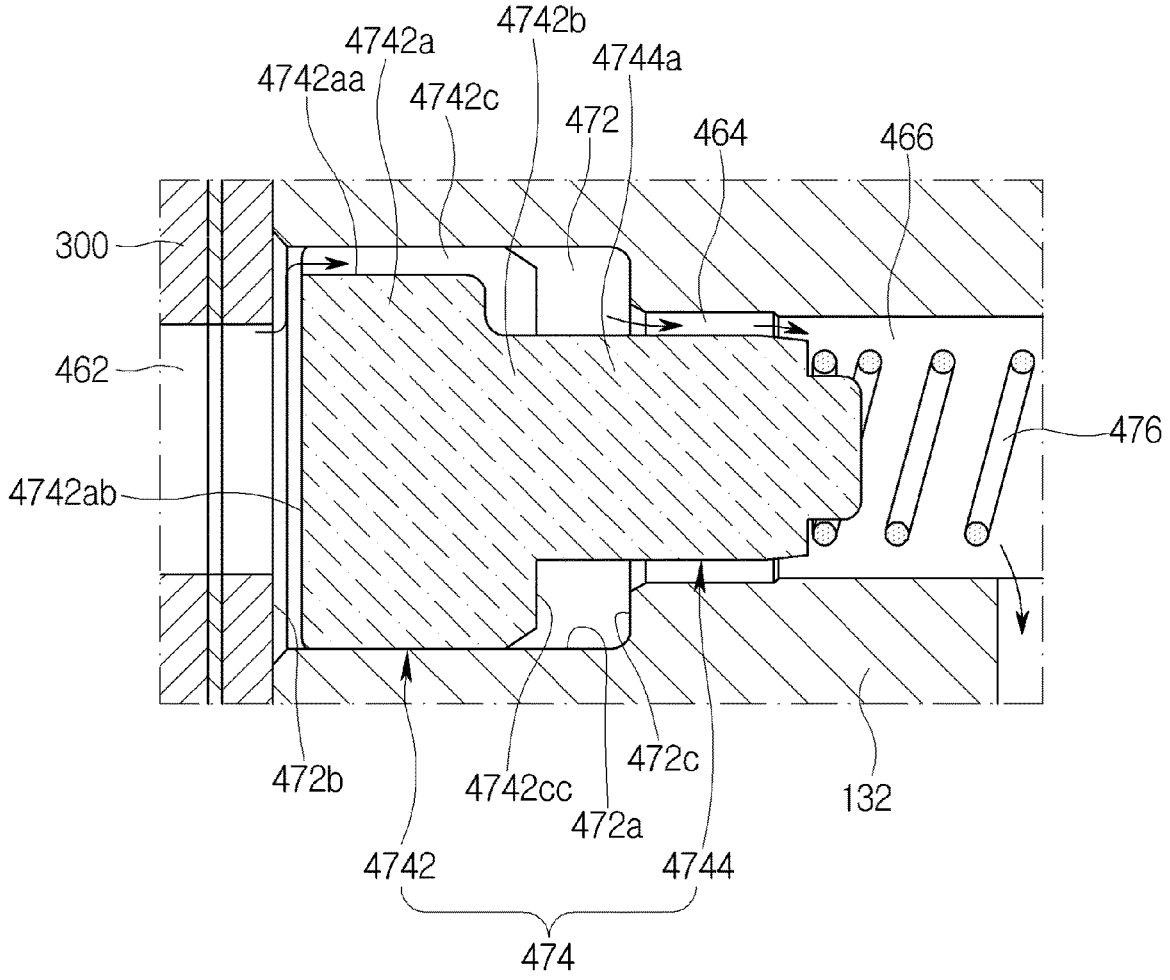
FIG. 6 is an enlarged cross-sectional view of the part "I" of FIG. 2 and shows that the differential pressure is greater than or equal to the first pressure and less than a second pressure.
Figure 7:
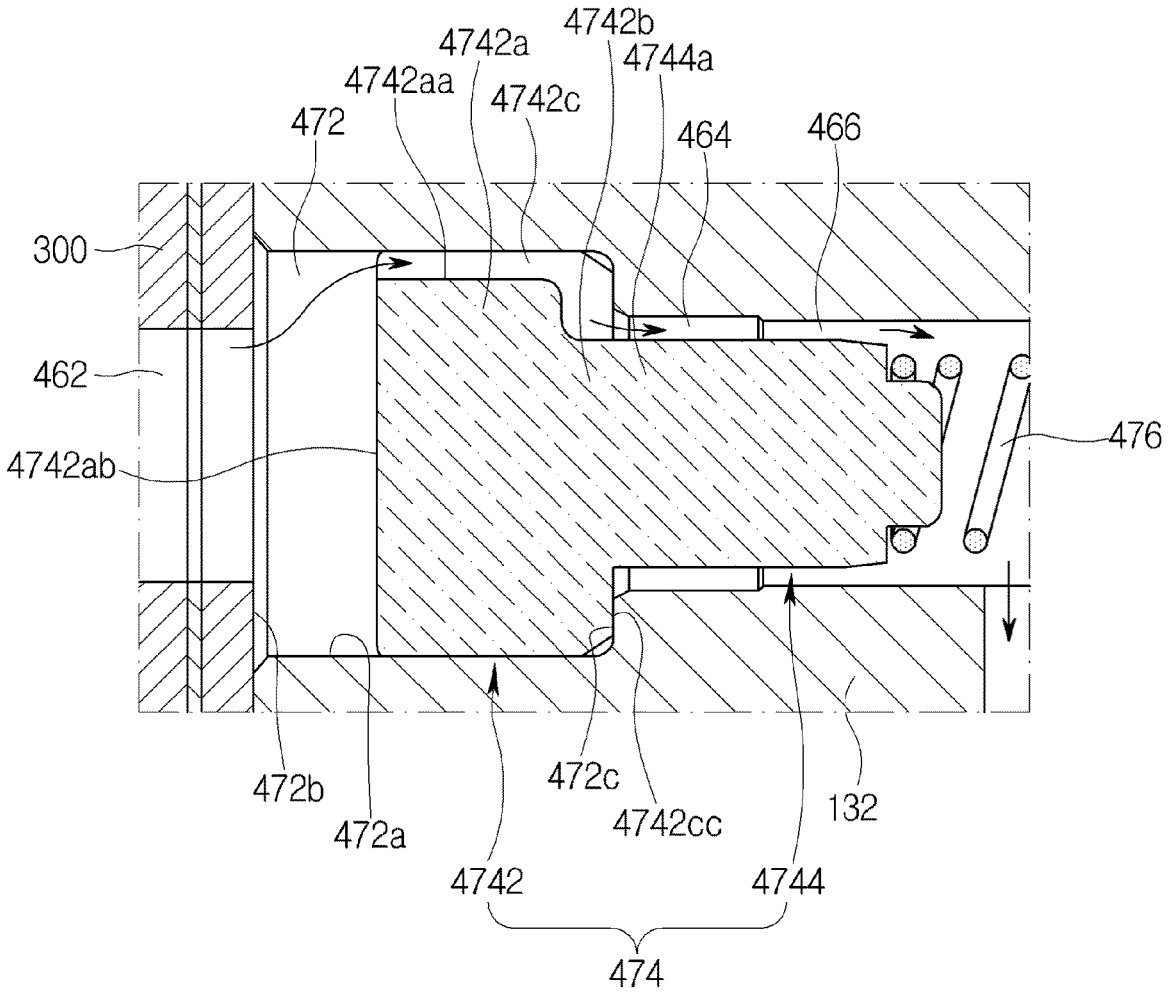
FIG. 7 is an enlarged cross-sectional view of the part "I" of FIG. 2 and shows that the differential pressure is greater than or equal to the second pressure.
Figure 8:
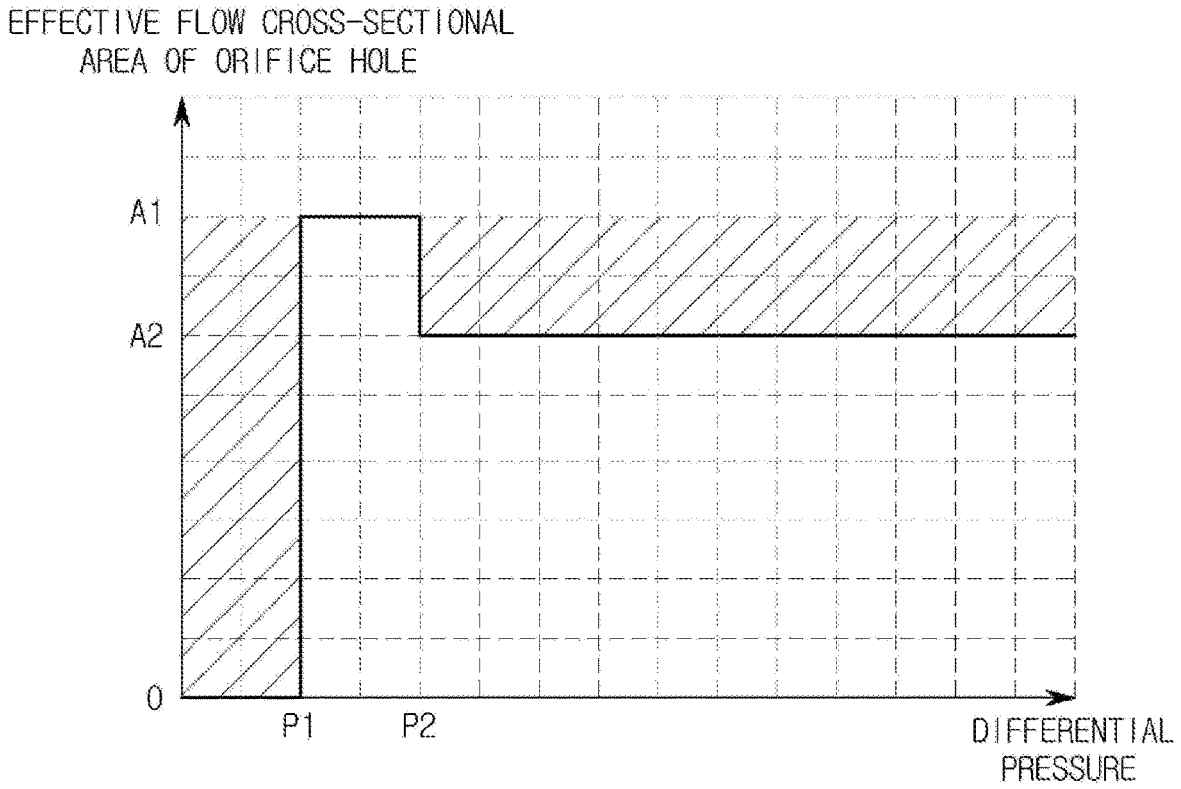
FIG. 8 is a graph showing changes in an effective flow cross-sectional area of an orifice hole according to the differential pressure in the variable displacement swash plate type compressor of FIG. 2.

FIG. 2 is a cross-sectional view showing a second flow path in the variable displacement swash plate type compressor according to an embodiment of the present disclosure. FIG. 3 is a perspective view of a valve core of FIG. 2 when viewed from one side. FIG. 4 is a perspective view of the valve core of FIG. 2 when viewed from the other side. FIG. 5 is an enlarged cross-sectional view of a part "I" of FIG. 2 and shows that a differential pressure is less than a first pressure. FIG. 6 is an enlarged cross-sectional view of the part "I" of FIG. 2 and shows that the differential pressure is greater than or equal to the first pressure and less than a second pressure. FIG. 7 is an enlarged cross-sectional view of the part "I" of FIG. 2 and shows that the differential pressure is greater than or equal to the second pressure. FIG. 8 is a graph showing changes in an effective flow cross-sectional area of an orifice hole according to the differential pressure in the variable displacement swash plate type compressor of FIG. 2.

Figure 1:
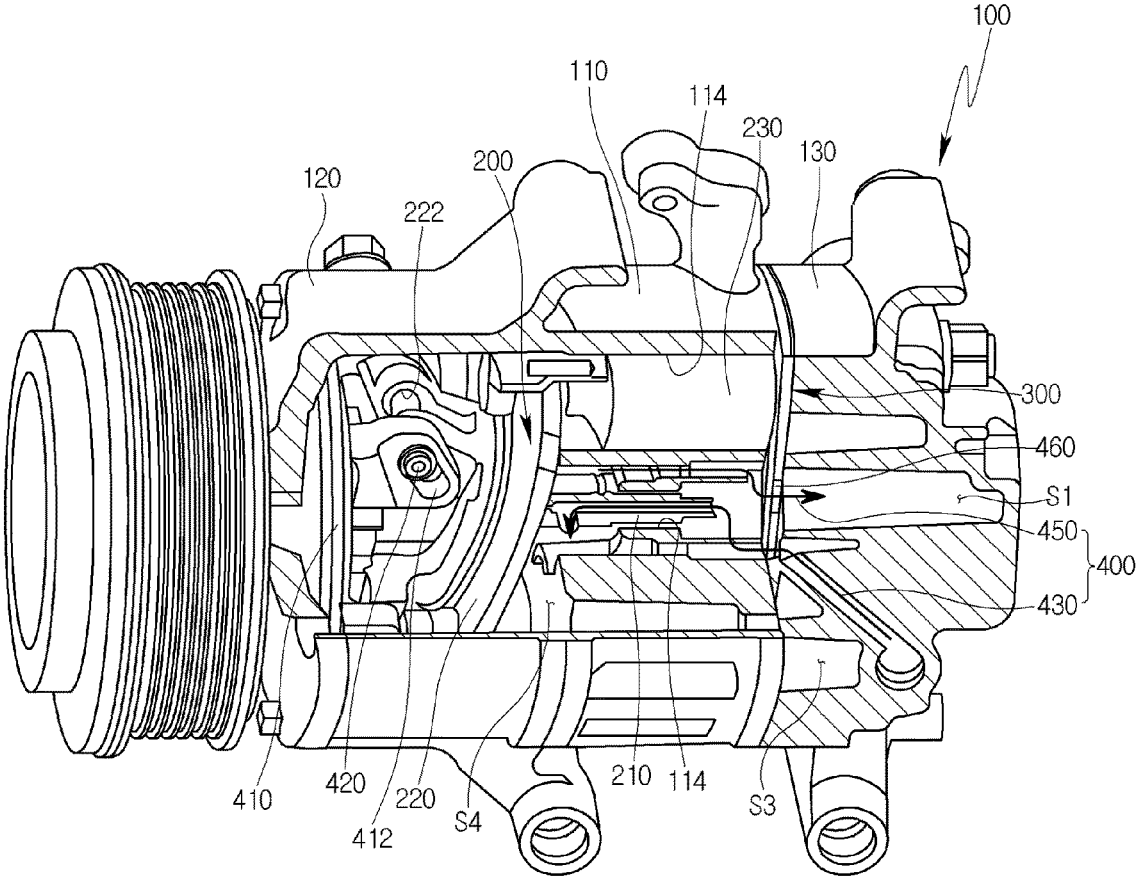
FIG. 1 is a perspective view showing a conventional variable displacement swash plate type compressor.

Meanwhile, components not shown in FIGS. 2 to 7 make reference to FIG. 1 for convenience of description.

Referring to accompanying FIGS. 2 to 7 and FIG. 1, the variable displacement swash plate type compressor according to the embodiment of the present disclosure may include a casing 100 and a compression mechanism 200 which is provided within the casing 100 and compresses refrigerant.

The casing 100 may include a cylinder block 110 in which the compression mechanism 200 is received, a front housing 120 which is coupled to a front side of the cylinder block 110, and a rear housing 130 which is coupled to a rear side of the cylinder block 110.

On the center side of the cylinder block 110, a shaft receiving hole 112 into which a later-mentioned rotating shaft 210 is inserted is formed. A piston 230 to be described later is inserted into the outer circumferential portion of the cylinder block 110, and a bore 114 which forms, together with the piston 230, a compression chamber may be formed.

The shaft receiving hole 112 may be formed in a cylindrical shape passing through the cylinder block 110 along the axial direction of the cylinder block 110.

The bore 114 may be formed in a cylindrical shape passing through the cylinder block 110 along the axial direction of the cylinder block 110 at a portion spaced apart outward in a radial direction of the cylinder block 110 from the shaft receiving hole 112.

Also, n number of the bores 114 may be formed such that n number of the compression chambers are formed. The n number of bores 114 may be arranged along the circumferential direction of the cylinder block 110 around the shaft receiving hole 112.

The front housing 120 may be fastened to the cylinder block 110 on the opposite side of the rear housing 130 with respect to the cylinder block 110.

Here, the cylinder block 110 and the front housing 120 are fastened to each other to form a crankcase S4 between the cylinder block 110 and the front housing 120.

A swash plate 220 to be described later may be received in the crankcase S4.

The rear housing 130 may be fastened to the cylinder block 110 on the opposite side of the front housing 120 with respect to the cylinder block 110.

Also, the rear housing 130 may be formed with a suction chamber S1 in which the refrigerant to be introduced into the compression chamber is received and with a discharge chamber S3 in which the refrigerant discharged from the compression chamber is received.

The suction chamber S1 may be in communication with a refrigerant suction pipe (not shown) that guides the refrigerant to be compressed to the interior of the casing 100.

The discharge chamber S3 may be in communication with a refrigerant discharge pipe (not shown) that guides the compressed refrigerant to the outside of the casing 100.

The compressor mechanism 200 may be formed to suck the refrigerant from the suction chamber S1 into the compression chamber, to compress the sucked refrigerant in the compression chamber, and to discharge the compressed refrigerant from the compression chamber to the discharge chamber S3.

Specifically, the compression mechanism 200 may include the rotating shaft 210 which is rotatably supported on the casing 100 and is rotated by receiving a rotational force from a driving source (for example, an engine of a vehicle) (not shown), a swash plate 220 which is rotated within the crankcase S4 in conjunction with the rotating shaft 210, and a piston 230 which reciprocates within the bore 114 in conjunction with the swash plate 220.

The rotating shaft 210 may be formed in a cylindrical shape extending in one direction.

Also, one end of the rotating shaft 210 may be inserted into the cylinder block 110 (more precisely, the shaft receiving hole 112) and rotatably supported. The other end of the rotating shaft 210 may pass through the front housing 120 and protrude to the outside of the casing 100 and may be connected to the driving source (not shown).

The swash plate 220 may be formed in a disk shape and may be obliquely fastened to the rotating shaft 210 in the crankcase S4. Here, the swash plate 220 is fastened to the rotating shaft 210 such that the inclination angle of the swash plate 220 is variable. This will be described later.

N number of the pistons 230 are provided in corresponding to the bore 114. Each of the pistons 230 may be formed to be in conjunction with the swash plate 220 and reciprocate in the bore 114.

Specifically, the piston 230 may include one end which is inserted into the bore 114 and the other end which extends from the one end to the opposite side of the bore 114 and is connected to the swash plate 220 in the crankcase S4.

Also, the variable displacement swash plate type compressor according to the embodiment may further include a valve mechanism 300 which communicates and shields the suction chamber S1 and the discharge chamber S3 with and from the compression chamber.

The valve mechanism 300 may include a valve plate interposed between the cylinder block 110 and the rear housing 130, a suction lid interposed between the cylinder block 110 and the valve plate, and a discharge lid interposed between the valve plate and the rear housings 130.

The valve plate may be formed approximately in a disk shape and may include a suction port through which the refrigerant to be compressed passes and a discharge port through which the compressed refrigerant passes.

N number of the suction ports may be formed in correspondence to the compression chamber, and the n number of suction ports may be arranged along the circumferential direction of the valve plate.

N number of the discharge ports may be also formed in correspondence to the compression chamber, and the n number of discharge ports may be arranged along the circumferential direction of the valve plate from the central point of the valve plate with respect to the suction port.

The suction lid may be formed approximately in a disk shape and may include a suction valve which opens and closes the suction port and a discharge hole which communicates the compression chamber with the discharge port.

The suction valve may be formed in a cantilevered shape, and n number of the suction valves may be formed in correspondence to the compression chamber and the suction port. The n number of suction valves may be arranged along the circumferential direction of the suction lid.

The discharge hole may be formed to pass through the suction lid from the base of the suction valve, and n number of the discharge holes may be formed in correspondence to the compression chamber and the discharge port. The n number of discharge holes may be arranged along the circumferential direction of the suction lid.

The discharge lid may be formed approximately in a disk shape and may include a discharge valve which opens and closes the discharge port and a suction hole which communicates the suction chamber S1 with the suction port.

The discharge valve may be formed in a cantilevered shape, and n number of the discharge valves may be formed in correspondence to the compression chamber and the discharge port. The n number of discharge valves may be arranged along the circumferential direction of the discharge lid.

The suction hole may be formed to pass through the discharge lid from the base of the discharge valve, and n number of the suction holes may be formed in correspondence to the compression chamber and the suction port. The n number of suction holes may be arranged along the circumferential direction of the discharge lid.

Also, the swash plate type compressor according to the embodiment of the present disclosure may further include a discharge gasket interposed between the discharge lid and the rear housing 130.

Also, the variable displacement swash plate type compressor according to the embodiment may further include an inclination adjustment mechanism 400 which adjusts the inclination angle of the swash plate 220 with respect to the rotating shaft 210.

The inclination adjustment mechanism 400 may include a rotor 410 and a sliding pin 420. The rotor 410 is fastened to the rotating shaft 210 such that the swash plate 220 is fastened to the rotating shaft 210 in such a way to have a variable inclination angle, and rotates together with the rotating shaft 210. The sliding pin 420 connects the swash plate 220 and the rotor 410.

The sliding pin 420 is formed in a cylindrical shape. A first insertion hole 222 into which the sliding pin 420 is inserted may be formed in the swash plate 220, and a second insertion hole 412 into which the sliding pin 420 is inserted may be formed in the rotor 410.

The first insertion hole 222 may be formed in a cylindrical shape such that the sliding pin 420 is rotatable within the first insertion hole 222.

The second insertion hole 412 may be formed to extend in one direction such that the sliding pin 420 can move along the second insertion hole 412.

Here, a central portion of the sliding pin 420 may be inserted into the first insertion hole 222, and an end of the sliding pin 420 may be inserted into the second insertion hole 412.

Then, in order that the inclination angle of the swash plate 220 is adjusted by controlling a differential pressure between the pressure in the crankcase S4 and the pressure in the suction chamber S1 (more precisely, the pressure in the crankcase S4), the inclination adjustment mechanism 400 may include a first flow path 430 which communicates the discharge chamber S3 with the crankcase S4, and a second flow path 450 which communicates the crankcase S4 with the suction chamber S1.

The first flow path 430 may be formed to extend from the discharge chamber S3 to the crankcase S4 by passing through the rear housing 130, the valve mechanism 300, the cylinder block 110, and the rotating shaft 210.

Also, a pressure control valve (not shown) which opens and closes the first flow path 430 may be formed in the first flow path 430.

The pressure control valve (not shown) may be formed as a so-called mechanical valve (MCV) or an electronic valve (ECV).

Also, the pressure control valve (not shown) may be formed to close and open the first flow path 430, and also to control the opening amount of the first flow path 430 when the first flow path 430 is opened.

The second flow path 450 may be formed to extend from the crankcase S4 to the suction chamber S1 by passing through the cylinder block 110 and the valve mechanism 300.

Also, the second flow path 450 has an orifice hole 460 and an orifice control mechanism 470. The orifice hole 460 decompresses a fluid passing through the second flow path 450 in order to prevent the pressure in the suction chamber S1 from rising. The orifice control mechanism 470 controls an effective flow cross-sectional area of the orifice hole 460 so as to prevent the reduction in compressor efficiency due to refrigerant leakage.

Here, some terms are defined as follows. the cross-sectional area of the orifice hole 460 is the area of the orifice hole 460 itself, and the flow cross-sectional area of the orifice hole 460 is the area through which the refrigerant passes in the cross-sectional area of the orifice hole 460. The effective flow cross-sectional area of the orifice hole 460 is the flow cross-sectional area of the orifice hole 460 which becomes a bottleneck among a plurality of orifice holes 460 when the plurality of orifice holes 460 are formed. That is, for example, it is assumed that there is one orifice hole having a cross-sectional area of 10 $mm^2$ and there is another orifice hole which is connected in series with the one orifice hole and has a cross-sectional area of 5 $mm^2$. Here, when the one orifice hole is opened only by 2 $mm^2$ and the other orifice hole is opened only by 3 $mm^2$, the cross-sectional area of the one orifice hole is 10 $mm^2$ and the flow cross-sectional area of the one orifice hole is 2 $mm^2$, and the cross-sectional area of the other orifice hole is 5 $mm^2$ and the flow cross-sectional area of the other orifice hole is 3 $mm^2$. Then, the one orifice hole becomes a bottleneck of all the orifice holes, and the effective flow cross-sectional area of all the orifice holes is 2 $mm^2$ equal to the flow cross-sectional area of the one orifice hole.

Subsequently, the orifice hole 460 may include a first orifice hole 462, a second orifice hole 464, and a third orifice hole 466. The first orifice hole 462 communicates the crankcase S4 with a below-described valve chamber 472 and decompresses the refrigerant which is introduced from the crankcase S4. The second orifice hole 464 communicates the below-described valve chamber 472 with the below-described third orifice hole 466 and decompresses the refrigerant which has passed through the first orifice hole 462. The third orifice hole 466 communicates the second orifice hole 464 with the suction chamber S1 and decompresses the refrigerant which has passed through the second orifice hole 464.

The first orifice hole 462 may be in communication with the below-described valve chamber 472 at a below-described valve chamber first front end surface 472*b* such that the first orifice hole 462 can be opened and closed quickly during the reciprocating motion of a below-described valve core 474 and pressure is continuously applied to a bottom surface 4742*ab* of a below-described first cylindrical portion.

Also, the inner diameter of the first orifice hole 462 may be less than the outer diameter of a plurality of protrusions 4742*c* to be described later such that a below-described first end 4742 is prevented from escaping from the below-described valve chamber 472 through the first orifice hole 462.

Also, the inner diameter of the first orifice hole 462 may be less than the outer diameter of a below-described first cylindrical portion 4742*a* such that the first orifice hole 462 is opened and closed by the bottom surface 4742*ab* of the below-described first cylindrical portion.

The second orifice hole 464 may be in communication with the below-described valve chamber 472 at a below-described valve chamber second front end surface 472*c* the such that a below-described third cylindrical portion 4744*a* can be inserted into the second orifice hole 464.

Also, the inner diameter of the second orifice hole 464 may be larger than the outer diameter of the below-described third cylindrical portion 4744*a* such that the second orifice hole 464 can decompress the refrigerant in a state where the below-described third cylindrical portion 4744*a* has been inserted into the second orifice hole 464.

Also, the inner diameter of the second orifice hole 464 may be less than the outer diameter of the plurality of protrusions 4742*c* to be described later such that the below-described first end 4742 is prevented from escaping from the below-described valve chamber 472 through the second orifice hole 464.

The third orifice hole 466 may be in communication with the second orifice hole 464 at a position facing the below-described valve chamber 472 such that the below-described third cylindrical portion 4744*a* can be inserted into the third orifice hole 466.

Also, the inner diameter of the third orifice hole 466 may be larger than the outer diameter of the below-described third cylindrical portion 4744*a* such that the third orifice hole 466 can decompress the refrigerant in a state where the below-described third cylindrical portion 4744*a* has been inserted into the third orifice hole 466.

Also, the inner diameter of the third orifice hole 466 may be less than the inner diameter of the second orifice hole 464 such that the opening amount of the third orifice hole 466 is less than the opening amount of the second orifice hole 464 when the below-described third cylindrical portion 4744*a* is inserted into both the second orifice hole 464 and the third orifice hole 466.

Here, the orifice hole 460 may be formed such that the first orifice hole 462, the below-described valve chamber 472, the second orifice hole 464, and the third orifice hole 466 are sequentially arranged according to the direction of the reciprocating motion of the below-described valve core 474.

The orifice control mechanism 470 may include the valve chamber 472, the valve core 474, and an elastic member 476. The valve chamber 472 is in communication with the first orifice hole 462 and the second orifice hole 464. The valve core 474 reciprocates along the valve chamber 472 and controls the opening amount of the first orifice hole 462, the opening amount of the second orifice hole 464, and the opening amount of the third orifice hole 466. The elastic member 476 applies an elastic force to the valve core 474.

The valve chamber 472 may include a valve chamber inner circumferential surface 472*a*, the valve chamber first front end surface 472*b*, and the valve chamber second front end surface 472*c*. The valve chamber inner circumferential surface 472*a* guides the reciprocating motion of the valve core 474. The valve chamber first front end surface 472*b* is located at one end side of the valve chamber inner circumferential surface 472*a*. The valve chamber second front end surface 472*c* is located at the other end side of the valve chamber inner circumferential surface 472*a*.

The valve core 474 may include the first end 4742 and a second end 4744. The first end 4742 reciprocates within the valve chamber 472 and controls the opening amount of the first orifice hole 462. The second end 4744 extends from the first end 4742 and reciprocates together with the first end 4742, and controls the opening amounts of the second orifice hole 464 and the third orifice hole 466.

The first end 4472 may include a first cylindrical portion 4742*a*. The first cylindrical portion 4742*a* includes an outer circumferential surface 4742*aa* facing the valve chamber inner circumferential surface 472*a*, the bottom surface 4742*ab* facing the valve chamber first front end surface 472*b*, and an upper surface 4742*ac* facing the valve chamber second front end surface 472*c*.

Also, the first end 4472 may further include a second cylindrical portion 4742*b*. The second cylindrical portion 4742*b* extends from the upper surface 4742*ac* of the first cylindrical portion to the valve chamber second front end surface 472*c* side (the second orifice hole 464 side) and forms a concentric circle with the first cylindrical portion 4742*a*.

Also, the first end 4472 may further include the plurality of protrusions 4742*c* which are formed radially from the outer circumferential surface 4742*aa* of the first cylindrical portion and the outer circumferential surface of the second cylindrical portion with respect to the central axes of the first cylindrical portion 4742*a* and the second cylindrical portion 4742*b*.

Here, in the first end 4472, in order that the plurality of protrusions 4742*c* slide in close contact with the valve chamber inner circumferential surface 472*a*, the outer diameter of the plurality of protrusions 4742*c* may be formed at an equal level to the inner diameter of the valve chamber 472, and the length of the plurality of protrusions 4742*c* may be less than the length of the valve chamber 472. Here, the length is a value measured along the direction of the reciprocating motion of the valve core 474.

Also, in the first end 4742, in order that the bottom surface 4742*ab* of the first cylindrical portion contacts the valve chamber first front end surface 472*b* and closes the first orifice hole 462, and in order that the bottom surface 4742*ab* of the first cylindrical portion is spaced from the valve chamber first front end surface 472*b* and the first orifice hole 462 is opened, the bottom surface 4742*ab* of the first cylindrical portion may be formed in parallel with the valve chamber first front end surface 472*b*.

Also, in the first end 4742, in order that the refrigerant discharged from the first orifice hole 462 flows through the outer circumferential portion of the first cylindrical portion 4742*a*, the outer circumferential surface 4742*aa* of the first cylindrical portion may be formed apart from the valve chamber inner circumferential surface 472*a*. That is, the outer diameter of the first cylindrical portion 4742*a* may be less than the outer diameter of the plurality of protrusions 4742*c* formed at an equal level to the inner diameter of the valve chamber 472.

Also, in the first end 4742, in order that the refrigerant flowing through the outer circumferential portion of the first cylindrical portion 4742*a* is always introduced into the second orifice hole 464, the outer diameter of the second cylindrical portion 4742*b* is formed at an equal level to the outer diameter of the below-described third cylindrical portion 4744*a*, so that the outer diameter of the second cylindrical portion 4742*b* may be less than the outer diameter of the first cylindrical portion 4742*a* and the inner diameter of the second orifice hole 464. Also, a length obtained by adding the length of the first cylindrical portion 4742*a* and the length of the second cylindrical portion 4742*b* is formed at an equal level to the length of the plurality of protrusions 4742*c*, so that the upper surface 4742*ac* of the first cylindrical portion may be formed apart from the valve chamber second front end surface 472*c*.

The second end 4744 may include the third cylindrical portion 4744*a* which extends from the second cylindrical portion 4742*b* to the opposite side of the first cylindrical portion 4742*a* (the second orifice hole 464 side) and forms a concentric circle with the second cylindrical portion 4742*b*.

As described above, in order that the third cylindrical portion 4744*a* can be inserted into the second orifice hole 464 and the third orifice hole 466, the outer diameter of the third cylindrical portion 4744*a* may be less than the inner diameter of the second orifice hole 464 and the inner diameter of the third orifice hole 466, the length of the third cylindrical portion 4744*a* may be greater than the length of the second orifice hole 464.

Also, in the third cylindrical portion 4744*a*, in order to prevent that an upper surface 4744*ac* of the third cylindrical portion 4744*a* (the surface opposite to the basal surface of the third orifice hole 466) is moved further toward the basal surface of the third orifice hole 466 than a predetermined position, the length of the third cylindrical portion 4744*a* may be less than a length obtained by adding the length of the second orifice hole 464 and the length of the third orifice hole 466.

Also, in order that the third cylindrical portion 4744*a* is always inserted into the second orifice hole 464 regardless of the reciprocating motion of the valve core 474, a length obtained by adding the length of the third cylindrical portion 4744*a* and the length of the plurality of protrusions 4742*c* may be greater than the length of the valve chamber 472. Here, unlike the embodiment of the present disclosure, a length obtained by adding the length of the third cylindrical portion 4744*a* and the length of the plurality of protrusions 4742*c* may be less than or equal to the length of the valve chamber 472. However, in this case, since the third cylindrical portion 4744*a* which is being inserted into the second orifice hole 464 may be caught in the second orifice hole 464, it is preferable that, as in this embodiment, the length obtained by adding the length of the third cylindrical portion 4744*a* and the length of the plurality of protrusions 4742*c* should be greater than the length of the valve chamber 472.

Also, in order that the third cylindrical portion 4744*a* can enter and exit the third orifice hole 466 in accordance with the reciprocating motion of the valve core 474, and as described later, in order that the second orifice hole 464 is a bottleneck of the orifice hole 460 in a certain pressure range and the third orifice hole 466 is the bottleneck of the orifice hole 460 in a higher pressure range than the certain pressure range, the length obtained by adding the length of the third cylindrical portion 4744*a* and the length of the plurality of protrusions 4742*c* may be less than a length obtained by adding the length of the valve chamber 472 and the length of the second orifice hole 464.

The elastic member 476 may be formed of, for example, a compression coil spring to press the valve core 474 toward the valve chamber first front end surface 472*b*. The compression coil spring is provided in a space between the upper surface 4744*ac* of the third cylindrical portion and the basal surface of the third orifice hole 466.

On the other hand, the outlet of the third orifice hole 466 may be formed on the inner circumferential surface of the third orifice hole 466 such that the elastic member 476 does not interfere with the flow of the refrigerant passing through the third orifice hole 466.

Also, the outlet of the third orifice hole 466 may be formed at a portion of the inner circumferential surface of the third orifice hole 466, which contacts the basal surface of the third orifice hole 466 in such a way as to always communicate with a space between the upper surface 4744*ac* of the third cylindrical portion and the basal surface of the third orifice hole 466.

Meanwhile, the rear housing 130 includes a post portion 132 which extends from the inner wall surface of the rear housing 130 and is supported by the valve mechanism in order to prevent the deformation of the rear housing 130. For the purpose of structure simplification and cost reduction, the valve chamber 472, the second orifice hole 464, and the third orifice hole 466 are formed in the post portion 132, and the first orifice hole 462 may be formed in the valve mechanism (particularly, a portion of the valve mechanism, which supports the post portion 132).

Hereinafter, an operation effect of the swash plate type compressor according to the embodiment will be described.

That is, when the power is transmitted from the driving source (not shown) to the rotating shaft 210, the rotating shaft 210 and the swash plate 220 may rotate together.

Also, the piston 230 may reciprocate within the bore 114 by converting the rotational motion of the swash plate 220 into a linear motion.

Also, when the piston 230 moves from the top dead center to the bottom dead center, the compression chamber communicates with the suction chamber S1 by the valve mechanism 300 and is shielded from the discharge chamber S3, so that the refrigerant in the suction chamber S1 may be sucked into the compression chamber. That is, when the piston 230 moves from the top dead center to the bottom dead center, the suction valve may open the suction port and the discharge valve may close the discharge port, and then, the refrigerant in the suction chamber S1 may be sucked into the compression chamber through the suction hole and the suction port.

Also, when the piston 230 moves from the bottom dead center to the top dead center, the compression chamber is shielded from the suction chamber S1 and the discharge chamber S3 by the valve mechanism 300, and the refrigerant in the compression chamber may be compressed. That is, when the piston 230 moves from the bottom dead center to the top dead center, the suction valve may close the suction port and the discharge valve may close the discharge port, and then the refrigerant in the compression chamber may be compressed.

Also, when the piston 230 reaches the top dead center, the compression chamber is shielded from the suction chamber S1 by the valve mechanism 300 and communicates with the discharge chamber S3, so that the refrigerant compressed in the compression chamber may be discharged to the discharge chamber S3. That is, when the piston 230 reaches the top dead center, the suction valve may close the suction port and the discharge valve may open the discharge port, and then the refrigerant compressed in the compression chamber may be discharged to the discharge chamber S3 through the discharge hole and the discharge port.

Here, in the variable displacement swash plate type compressor according to the embodiment, the refrigerant discharge amount may be controlled as follows.

First, when the compressor is stopped, the compressor is set to a minimum mode in which the refrigerant discharge amount is minimum. That is, the swash plate 220 is disposed close to perpendicular to the rotating shaft 210, an inclination angle of the swash plate 220 may be close to zero. Here, the inclination angle of the swash plate 220 may be measured as an angle between the rotating shaft 210 of the swash plate 220 and a normal of the swash plate 220, based on the center of rotation of the swash plate 220.

Next, when the operation of the compressor starts, the compressor is adjusted to a maximum mode in which the refrigerant discharge amount is maximum. That is, the first flow path 430 may be closed by the pressure control valve (not shown) and the pressure in the crankcase S4 may be reduced to the level of the suction pressure. That is, a differential pressure between the pressure in the crankcase S4 and the pressure in the suction chamber S1 may be reduced to the minimum degree. Accordingly, the pressure in the crankcase S4 applied to the piston 230 is reduced to the minimum degree, and the stroke of the piston 230 is increased to the maximum degree. Then, the inclination angle of the swash plate 220 is increased to the maximum degree, and the refrigerant discharge amount is increased to the maximum degree.

Next, after the maximum mode, based on the required refrigerant discharge amount, the opening amount of the first flow path 430 may be controlled by the pressure control valve (not shown), so that the pressure in the crankcase S4 may be controlled. That is, the differential pressure between the pressure in the crankcase S4 and the pressure in the suction chamber S1 may be controlled. Accordingly, the pressure in the crankcase S4 applied to the piston 230 is controlled, so that the stroke of the piston 230 may be adjusted, the inclination angle of the swash plate 220 may be adjusted, and the refrigerant discharge amount may be adjusted.

That is, for example, when the refrigerant discharge amount is required to be decreased after being increased to the maximum degree, the first flow path 430 is opened by the pressure control valve (not shown), and the opening amount of the first flow path 430 is increased by the pressure control valve (not shown), so that the pressure in the crankcase S4 may be increased. That is, the differential pressure between the pressure in the crankcase S4 and the pressure in the suction chamber S1 may be increased. Accordingly, the pressure in the crankcase S4 applied to the piston 230 is increased, so that the stroke of the piston 230 may be reduced, the inclination angle of the swash plate 220 may be reduced, and the refrigerant discharge amount may be reduced.

As another example, when the refrigerant discharge amount is required to be increased after being decreased, the first flow path 430 is opened by the pressure control valve (not shown), and the opening amount of the first flow path 430 is decreased by the pressure control valve (not shown), so that the pressure in the crankcase S4 may be decreased. That is, the differential pressure between the pressure in the crankcase S4 and the pressure in the suction chamber S1 may be reduced. Accordingly, the pressure in the crankcase S4 applied to the piston 230 is decreased, so that the stroke of the piston 230 may be increased, the inclination angle of the swash plate 220 may be increased, and the refrigerant discharge amount may be increased.

Here, in order to decrease the pressure in the crankcase S4, that is, in order to decrease the differential pressure between the pressure in the crankcase S4 and the pressure in the suction chamber S1, the amount of refrigerant which is introduced into the crankcase S4 from the discharge chamber S3 must be reduced by closing the first flow path 430 or by reducing the opening amount of the first flow path 430. Also, at the same time, the refrigerant in the crankcase S4 must be discharged to the outside of the crankcase S4. For this, provided are the second flow path 450 which guides the refrigerant in the crankcase S4 to the suction chamber S1 and the orifice hole 460 which decompresses the refrigerant passing through the second flow path 450 so as to prevent the pressure in the suction chamber S1 from rising.

However, when the effective flow cross-sectional area of the orifice hole 460 is always constant irrespective of the pressure in the crankcase S4 (the differential pressure between the pressure in the crankcase and the pressure in the suction chamber), there is a difficulty in achieving the rapid control of the refrigerant discharge amount and the prevention of reduction in compressor efficiency at the same time.

That is, when the effective flow cross-sectional area of the orifice hole 460 is formed to have a constant large area, when the pressure in the crankcase S4 (the differential pressure between the pressure in the crankcase and the pressure in the suction chamber) should be reduced, the refrigerant in the crankcase S4 can be quickly discharged to the suction chamber S1, and thus, it is advantageous in terms of responsiveness. However, when the pressure in the crankcase S4 should be maintained or increased, the refrigerant in the crankcase S4 unnecessarily leaks into the suction chamber S1, and thus, it may be disadvantageous in terms of efficiency.

On the other hand, when the effective flow cross-sectional area of the orifice hole 460 is formed to have a constant small area, the pressure in the crankcase S4 (the differential pressure between the pressure in the crankcase and the pressure in the suction chamber) should be maintained or increased, the amount of the refrigerant which leaks from the crankcase S4 to the suction chamber S1 is reduced, and thus, it is advantageous in terms of efficiency. However, when the pressure in the crankcase S4 (the differential pressure between the pressure in the crankcase and the pressure in the suction chamber) should be reduced, it is difficult for the refrigerant in the crankcase S4 to be discharged to the suction chamber S1, and thus, it may be disadvantageous in terms of responsiveness.

In consideration of this, in the embodiment, the first orifice hole 462, the valve chamber 472, the second orifice hole 464, and the third orifice hole 466 may be formed sequentially according to the direction of the reciprocating motion of the valve core 474. Also, the first end 4742 may be formed to be able to reciprocate within the valve chamber 472, and the second end 4744 may be formed to be able to reciprocate together with the first end 4742 with the insertion into the second orifice hole 464 and may be formed to be able to enter and exit the third orifice hole 466. Also, the inner diameter of the third orifice hole 466 may be formed to be less than the inner diameter of the second orifice hole 464, and the outer diameter of the third cylindrical portion 4744*a* may be formed to be less than the inner diameter of the third orifice hole 466, so that an area obtained by subtracting the area of the third cylindrical portion 4744*a* from the cross-sectional area of the second orifice hole 464 is formed as a first predetermined area A1, and an area obtained by subtracting the area of the third cylindrical portion 4744*a* from the cross-sectional area of the third orifice hole 466 may be formed as a second area A2 greater than zero and less than the first area A1. Also, the cross-sectional area of the first orifice hole 462 may be formed at an equal level to the first area A1. Also, an area obtained by subtracting the area of the first cylindrical portion 4742*a* and the area of the plurality of protrusions 4742*c* from the cross-sectional area of the valve chamber 472 may be formed to be equal to or greater than the cross-sectional area of the first orifice hole 462 such that the refrigerant which has passed through the first orifice hole 462 can flow smoothly toward the second orifice hole. That is, the area obtained by subtracting the area of the first cylindrical portion 4742*a* and the area of the plurality of protrusions 4742*c* from the cross-sectional area of the valve chamber 472 may be formed to be equal to or greater than the first area A1. Here, the first area A1 may be formed to the maximum degree within a range that sufficiently decompresses the refrigerant passing through the second flow path 450 and may be formed to be less than the cross-sectional area of the third orifice hole 466. Also, the opening amount of the first orifice hole 462 is controlled by the first end 4742, and the opening amount of the second orifice hole 464 and the opening amount of the third orifice hole 466 are controlled by the second end 4744, the effective flow cross-sectional area of the orifice hole 460 may be formed to change according to the pressure in the crankcase S4 (the differential pressure between the pressure in the crankcase and the pressure in the suction chamber). As a result of this, it is possible to achieve rapid control of the refrigerant discharge amount and the prevention of reduction in compressor efficiency at the same time.

Specifically, first, as the inner diameter of the valve chamber 472, the inner diameter of the second orifice hole 464, and the inner diameter of the third orifice hole 466 are formed to be larger than the outer diameter of the third cylindrical portion 4744*a*, the valve chamber 472, the second orifice hole 464 and the third orifice hole 466 may always be in communication with the suction chamber S1 regardless of the differential pressure between the pressure in the crankcase S4 and the pressure in the suction chamber S1 (regardless of the position of the valve core 474).

In this situation, when the differential pressure between the pressure in the crankcase S4 and the pressure in the suction chamber S1 is less than the first pressure P1, a force applied to one side of the valve core 474 (a value obtained through multiplication of the pressure which passes through the first orifice hole 462 from the crankcase S4 and is applied to the bottom surface 4742*ab* of the first cylindrical portion and a pressure application area thereof) may be equal to or less than a force applied to the other side of the valve core 474 (a force obtained by adding a force applied by the elastic member 476 and a value obtained through multiplication of the pressure applied to the upper surface 4742*ac* of the first cylindrical portion, to an upper surface 4742*cc* of the plurality of protrusions, and to the upper surface 4744*ac* of the third cylindrical portion and a pressure application area thereof).

Accordingly, as shown in FIG. 5, the valve core 474 moves toward the valve chamber first front end surface 472*b*, so that the bottom surface 4742*ab* of the first cylindrical portion comes in contact with the valve chamber first front end surface 472*b*. Thus, the first orifice hole 462 may be closed by the valve core 474.

Accordingly, the refrigerant in the crankcase S4 cannot flow toward the suction chamber S1.

Here, as the first orifice hole 462 is completely closed, the flow cross-sectional area of the first orifice hole 462 may be zero.

Also, the first orifice hole 462 becomes a bottleneck of the orifice hole 460, and the effective flow cross-sectional area of the orifice hole 460 may be, as shown in FIG. 8, zero that is the flow cross-sectional area of the first orifice hole 462.

Next, when the differential pressure between the pressure in the crankcase S4 and the pressure in the suction chamber S1 is greater than or equal to the first pressure P1 and less than the second pressure P2, the force applied to one side of the valve core 474 may be greater than the force applied to the other side of the valve core 474.

Accordingly, as shown in FIG. 6, the valve core 474 moves toward the valve chamber second front end surface 472*c*, so that the bottom surface 4742*ab* of the first cylindrical portion may be spaced apart from the valve chamber first front end surface 472*b* and the first orifice hole 462 may be opened.

Accordingly, the refrigerant in the crankcase S4 may flow toward the suction chamber S1. That is, the refrigerant in the crankcase S4 may pass through the first orifice hole 462 and may be introduced into a space between the valve chamber first front end surface 472*b* and first end 4742. Also, the refrigerant in the space between the valve chamber first front end surface 472*b* and first end 4742 may be introduced into a space between the valve chamber inner circumferential surface 472*a* and the outer circumferential surface 4742*aa* of the first cylindrical portion. Also, the refrigerant in the space between the valve chamber inner circumferential surface 472*a* and the outer circumferential surface 4742*aa* of the first cylindrical portion may be introduced into a space between the valve chamber inner circumferential surface 472*a* and the outer circumferential surface of the second cylindrical portion. Also, the refrigerant in the space between the valve chamber inner circumferential surface 472*a* and the outer circumferential surface of the second cylindrical portion may be introduced into a space between the valve chamber inner circumferential surface 472*a* and the outer circumferential surface of the third cylindrical portion. Also, the refrigerant in the space between the valve chamber inner circumferential surface 472*a* and the outer circumferential surface of the third cylindrical portion may be introduced into a space between the inner circumferential surface of the second orifice hole 464 and the outer circumferential surface of the third cylindrical portion. Also, the refrigerant in the space between the inner circumferential surface of the second orifice hole 464 and the outer circumferential surface of the third cylindrical portion may be introduced into the third orifice hole 466. Also, the refrigerant of the third orifice hole 466 may be discharged to the suction chamber S1 through the outlet of the third orifice hole 466.

Here, as the first orifice hole 462 is completely opened, the flow cross-sectional area of the first orifice hole 462 may be the first area A1 equal to the cross-sectional area of the first orifice hole 462.

Also, as the third cylindrical portion 4744*a* is inserted into the second orifice hole 464, the flow cross-sectional area of the second orifice hole 464 may be the first area A1 which is less than the cross-sectional area of the second orifice hole 464.

Meanwhile, as the third cylindrical portion 4744*a* is not inserted into the third orifice hole 466, the flow cross-sectional area of the third orifice hole 466 may be equal to the cross-sectional area of the third orifice hole 466. That is, the flow cross-sectional area of the third orifice hole 466 may be greater than the second area A2 and even greater than the first area A1.

Accordingly, the second orifice hole 464, together with the first orifice hole 462, becomes the bottleneck of the orifice hole 460. The effective flow cross-sectional area of the orifice hole 460 may be, as shown in FIG. 8, the first area A1 which is both the flow cross-sectional area of the second orifice hole 464 and the flow cross-sectional area of the first orifice hole 462.

Next, when the differential pressure between the pressure in the crankcase S4 and the pressure in the suction chamber S1 is greater than or equal to the second pressure P2, the force applied to one side of the valve core 474 may be greater than the force applied to the other side of the valve core 474.

Accordingly, as shown in FIG. 7, the valve core 474 moves toward the valve chamber second front end surface 472*c*, so that the bottom surface 4742*ab* of the first cylindrical portion may be further spaced apart from the valve chamber first front end surface 472*b* and the first orifice hole 462 may continue to be opened.

Accordingly, the refrigerant in the crankcase S4 may continue to flow toward the suction chamber S1. That is, the refrigerant in the crankcase S4 may pass through the first orifice hole 462 and may be introduced into a space between the valve chamber first front end surface 472*b* and first end 4742. Also, the refrigerant in the space between the valve chamber first front end surface 472*b* and first end 4742 may be introduced into a space between the valve chamber inner circumferential surface 472*a* and the outer circumferential surface 4742*aa* of the first cylindrical portion. Also, the refrigerant in the space between the valve chamber inner circumferential surface 472*a* and the outer circumferential surface 4742*aa* of the first cylindrical portion may be introduced into a space between the valve chamber inner circumferential surface 472*a* and the outer circumferential surface of the second cylindrical portion. Also, the refrigerant in the space between the valve chamber inner circumferential surface 472*a* and the outer circumferential surface of the second cylindrical portion may be introduced into a space between the inner circumferential surface of the second orifice hole 464 and the outer circumferential surface of the third cylindrical portion. Here, although the upper surface 4742*cc* of the plurality of protrusions comes in contact with the valve chamber second front end surface 472*c*, the refrigerant in the space between the valve chamber inner circumferential surface 472*a* and the outer circumferential surface 4742*aa* of the first cylindrical portion may be introduced into the space between the inner circumferential surface of the second orifice hole 464 and the outer circumferential surface of the third cylindrical portion by the second cylindrical portion 4742*b*. Also, the refrigerant in the space between the inner circumferential surface of the second orifice hole 464 and the outer circumferential surface of the third cylindrical portion may be introduced into a space between the inner circumferential surface of the third orifice hole 466 and the outer circumferential surface of the third cylindrical portion. Also, the refrigerant in the space between the inner circumferential surface of the third orifice hole 466 and the outer circumferential surface of the third cylindrical portion may be discharged to the suction chamber S1 through the outlet of the third orifice hole 466.

Here, as the first orifice hole 462 is still completely opened, the flow cross-sectional area of the first orifice hole 462 may be still the first area A1 equal to the cross-sectional area of the first orifice hole 462.

Also, as the third cylindrical portion 4744*a* is still inserted into the second orifice hole 464, the flow cross-sectional area of the second orifice hole 464 may be still the first area A1 which is less than the cross-sectional area of the second orifice hole 464.

Also, as the third cylindrical portion 4744*a* is inserted into the third orifice hole 466 as well as the second orifice hole 464, the flow cross-sectional area of the third orifice hole 466 may be the second area A2 that is less than the cross-sectional area of the third orifice hole 466 and less than the first area A1.

Accordingly, the third orifice hole 466 becomes the bottleneck of the orifice hole 460. The effective flow cross-sectional area of the orifice hole 460 may be, as shown in FIG. 8, the second area A2 which is the flow cross-sectional area of the third orifice hole 466.

Here, in the variable displacement swash plate type compressor according to the embodiment, the effective flow cross-sectional area of the orifice hole 460 is variable by the differential pressure between the pressure in the crankcase S4 and the pressure in the suction chamber S1 (more precisely, the pressure in the crankcase S4). Therefore, when the differential pressure between the pressure in the crankcase S4 and the pressure in the suction chamber S1 (more precisely, the pressure in the crankcase S4) should be maintained or increased, the amount of the refrigerant which leaks from the crankcase S4 to the suction chamber S1 may be reduced. That is, referring to FIG. 8, the differential pressure between the pressure in the crankcase S4 and the pressure in the suction chamber S1 is in a range less than the first pressure P1 and in a range equal to or greater than the second pressure P2, the effective flow cross-sectional area of the orifice hole 460 may be reduced than the first area A1. Accordingly, compared to when the effective flow cross-sectional area of the orifice hole 460 is constantly maintained to the first area A1 regardless of the differential pressure between the pressure in the crankcase S4 and the pressure in the suction chamber S1, when the differential pressure between the pressure in the crankcase S4 and the pressure in the suction chamber S1 should be maintained or increased, the amount of refrigerant which leaks from the crankcase S4 to the suction chamber S1 may be reduced as much as an oblique-lined part in FIG. 8. As a result of this, in order that the differential pressure between the pressure in the crankcase S4 and the pressure in the suction chamber S1 is adjusted to a desired level, the amount of the refrigerant which is introduced from the discharge chamber S3 into the crankcase S4 through the first flow path 430 may be reduced, and the amount of the refrigerant which is discharged from the discharge chamber S3 through the refrigerant discharge pipe (not shown) in a cooling cycle may be relatively increased. Accordingly, even if the compressor does relatively little work (compress), it is possible to easily achieve a desired cooling or heating level, so that the power required to drive the compressor is reduced, and compressor efficiency can be improved.

Also, as the first area A1 is formed to the maximum degree within a range that sufficiently decompresses the refrigerant passing through the second flow path 450, when the differential pressure between the pressure in the crankcase S4 and the pressure in the suction chamber S1 should be reduced, the refrigerant in the crankcase S4 can be rapidly discharged to the suction chamber S1, so that the responsiveness can be improved. That is, the refrigerant discharge amount can be quickly controlled.

Also, as the first area A1 is formed to be greater than the second area A2, the time required to switch to the maximum mode may be reduced. That is, in switching to the maximum mode, when the refrigerant in the crankcase S4 is smoothly discharged to the suction chamber S1 side even if the differential pressure between the pressure in the crankcase S4 and the pressure in the suction chamber S1 is gradually reduced to a level close to zero, the time required to switch to the maximum mode can be reduced. However, unlike the embodiment, when the first area A1 is formed to be less than the second area A2, the differential pressure between the pressure in the crankcase S4 and the pressure in the suction chamber S1 becomes less than the second pressure P2 and is reduced to a level close to zero, the effective flow cross-sectional area of the orifice hole 460 is reduced, so that the refrigerant in the crankcase S4 cannot be smoothly discharged to the suction chamber S1 side. Accordingly, the time required to switch to the maximum mode may be increased. On the other hand, in the embodiment, as the first area A1 is formed to be greater than the second area A2, the differential pressure between the pressure in the crankcase S4 and the pressure in the suction chamber S1 becomes less than the second pressure P2 and is reduced to a level close to zero, the effective flow cross-sectional area of the orifice hole 460 is increased, so that the refrigerant in the crankcase S4 can be smoothly discharged to the suction chamber S1 side. Accordingly, the time required to switch to the maximum mode may be reduced.

Meanwhile, as described above, when the differential pressure between the pressure in the crankcase S4 and the pressure in the suction chamber S1 is less than the first pressure P1, the effective flow cross-sectional area of the orifice hole 460 becomes zero. As a result, the compressor can be prevented from being damaged.

Specifically, a vehicle cooling system includes a vapor compression refrigeration cycle mechanism. The vapor compression refrigeration cycle mechanism includes not only a compressor that compresses a low-temperature and low-pressure gaseous refrigerant into a high-temperature and high-pressure gaseous refrigerant but also a condenser that condenses the high-temperature and high-pressure gaseous refrigerant discharged from the compressor into a low-temperature and high-pressure liquid refrigerant, an expansion valve that expands the low-temperature and high-pressure liquid refrigerant discharged from the condenser into a low-temperature and low-pressure liquid refrigerant, and an evaporator that evaporates the low-temperature and low-pressure liquid refrigerant discharged from the expansion valve into a low-temperature and low-pressure gaseous refrigerant.

In the vehicle cooling system according to such a configuration, when a start signal is input, the compressor is driven to compress the refrigerant, and the refrigerant discharged from the compressor is circulated through the condenser, the expansion valve, and the evaporator and is collected to the compressor. The condenser and the evaporator perform heat-exchange with air, and a portion of the air heat-exchanged with the condenser and the evaporator is supplied to the passenger room of the vehicle. Also, cooling, heating, and dehumidification are provided.

Here, in the conventional case, there is a problem that even when oil stored within the compressor for the purpose of the lubrication of the sliding portion of the compressor is insufficient, the compressor is driven and damaged. More specifically, when the vehicle is left for a long time in an external environment having a large daily temperature range, the daily temperature range causes the refrigerant and oil to move in a refrigeration cycle. That is, a migration phenomenon occurs. However, in the oil and the refrigerant transferred from the compressor to the condenser, the expansion valve, and evaporator, the relatively high viscous oil is not introduced into the compressor again, resulting in a deficient state where the amount of oil within the compressor is less than a predetermined reference amount of oil. When the compressor is driven in the oil deficient state, the friction of the sliding portion increases, and the sliding portion is sticked, resulting in the damage of the compressor.

However, in the embodiment of the present disclosure, when the compressor is stopped, the differential pressure between the pressure in the crankcase S4 and the pressure in the suction chamber S1 becomes zero and less than the first pressure P1. Then, the first orifice hole 462 is closed by the valve core 474, so that the effective flow cross-sectional area of the orifice hole 460 may be zero. As a result, since the refrigerant and the oil cannot move between the crankcase S4 and the suction chamber S1, the refrigerant and the oil within the compressor can be prevented from moving to the outside of the compressor. Accordingly, the amount of oil within the compressor can be prevented from being less than a predetermined reference amount of oil, and damage to the compressor due to deficient oil can be prevented.

On the other hand, in the embodiment of the present disclosure, in order to ensure the reliability of the behavior of the valve core 474 when the differential pressure between the pressure in the crankcase S4 and the pressure in the suction chamber S1 is reduced, the elastic member 476 is provided, and the elastic member 476 is formed to have a high modulus of elasticity.

Figure 9:
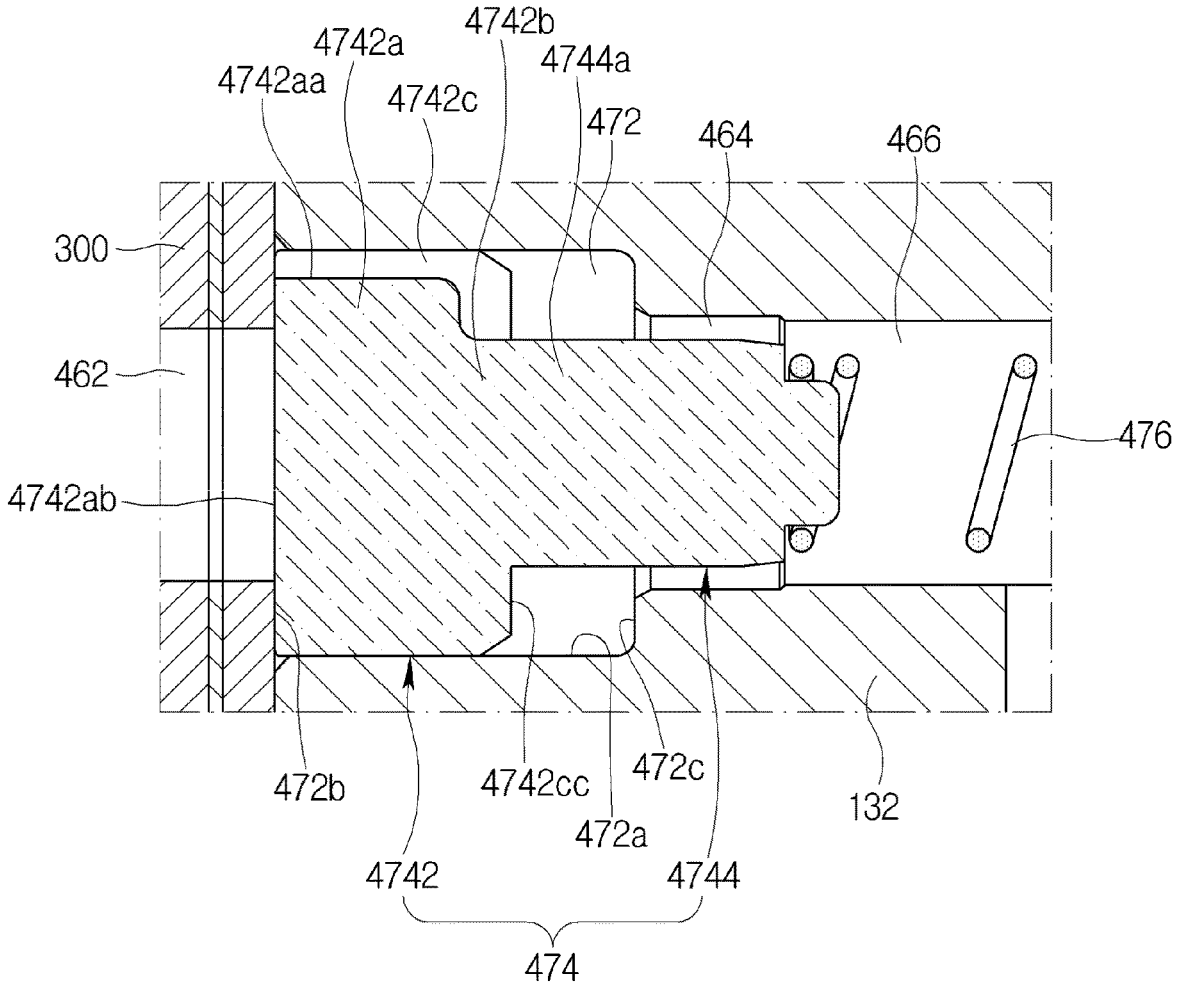
FIG. 9 is a cross-sectional view showing the second flow path in a variable displacement swash plate type compressor according to another embodiment of the present disclosure.
Figure 10:
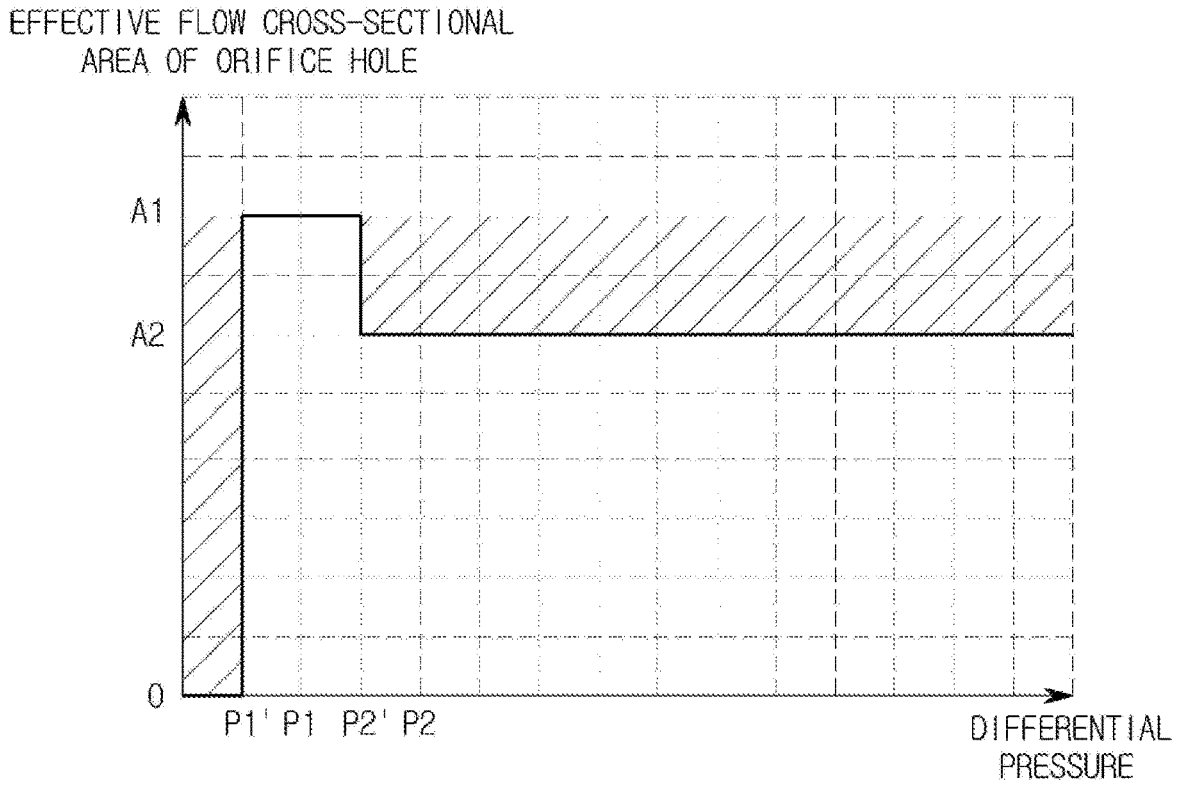
FIG. 10 is a graph showing changes in an effective flow cross-sectional area of the orifice hole according to the differential pressure in the variable displacement swash plate type compressor of FIG. 11.

However, the elastic member is not limited thereto, and as shown in FIGS. 9 and 10, in order to advance the opening time of the orifice hole 460, the elastic member 476 may be formed to have a low modulus of elasticity.

That is, when a pressure less than the first pressure P1 is referred to as a first new pressure P1' and a pressure less than the second pressure P2 is referred to as a second new pressure P2', the effective flow cross-sectional area of the orifice hole 460 may become the first area A1 in a range in which the differential pressure between the pressure in the crankcase S4 and the pressure in the suction chamber S1 is equal to or greater than the first new pressure P1' and is less than the second new pressure P2'.

Accordingly, as shown in FIG. 10, when the differential pressure between the pressure in the crankcase S4 and the pressure in the suction chamber S1 should be reduced (particularly, when adjusted to the maximum mode after starting the operation), the responsiveness can be improved.

Here, the elastic member 476 is mainly intended to return the valve core 474 to of the valve chamber first front end surface 472*b* side. Therefore, it may be desirable to improve the responsiveness by the fact that, when the differential pressure between the pressure in the crankcase S4 and the pressure in the suction chamber S1 becomes close to zero, the modulus of elasticity of the elastic member 476 should be as less as possible within a range in which the valve core 474 can be moved to the valve chamber first front end surface 472*b* side.

Meanwhile, in the embodiment, the cross-sectional area of the first orifice hole 462 is formed at an equal level to the first area A1, but is not limited thereto. The cross-sectional area of the first orifice hole 462 may be formed larger than the first area A1.

Meanwhile, in the embodiment, when the differential pressure between the pressure in the crankcase S4 and the pressure in the suction chamber S1 is less than the first pressure P1, the effective flow cross-sectional area may be formed to become zero, and when the differential pressure between the pressure in the crankcase S4 and the pressure in the suction chamber S1 is equal to or greater than the first pressure P1 and less than the second pressure P2, the effective flow cross-sectional area may be formed to be the first area A1, and when the differential pressure between the pressure in the crankcase S4 and the pressure in the suction chamber S1 is equal to or greater than the second pressure P2, the effective flow cross-sectional area may be formed to be the second area A2.

However, there is no limit to this.

Figure 11:
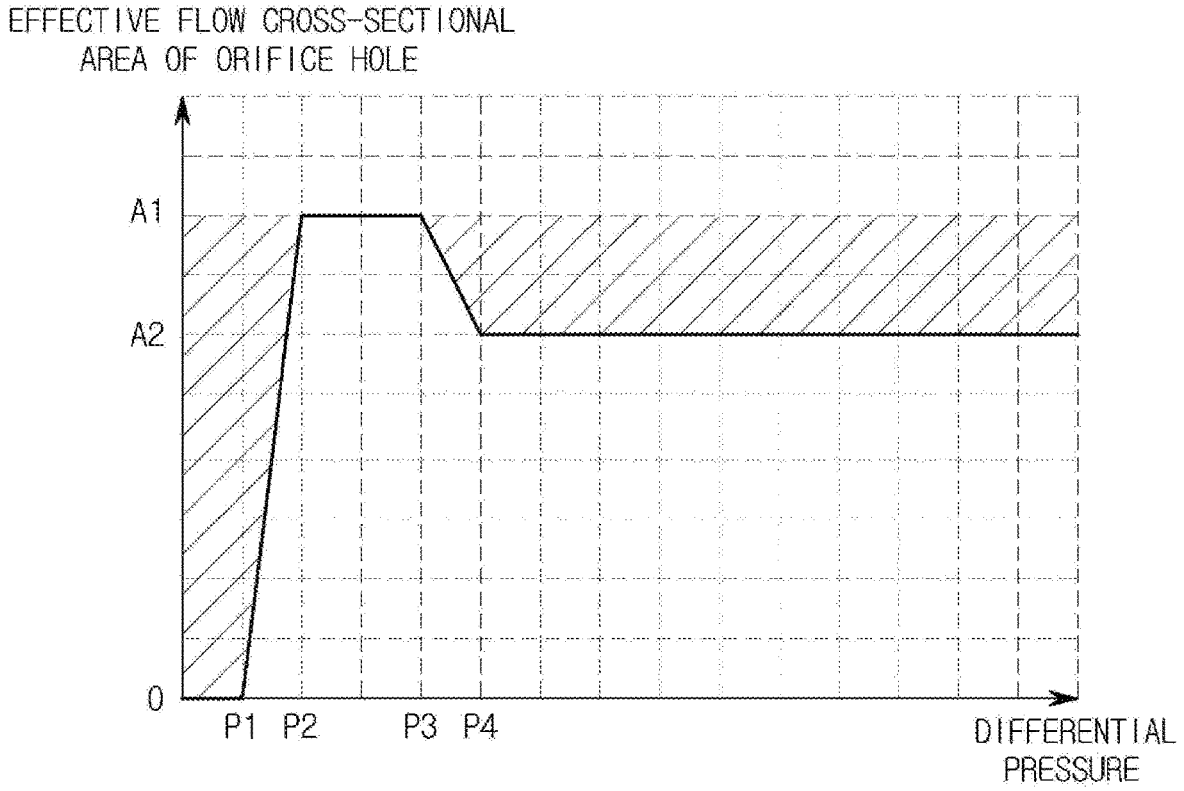
FIG. 11 is a graph showing changes in the effective flow cross-sectional area of the orifice hole according to the differential pressure in a variable displacement swash plate type compressor according to further another embodiment of the present disclosure.

That is, for example, as shown in FIG. 11, when the differential pressure between the pressure in the crankcase S4 and the pressure in the suction chamber S1 is less than the first pressure P1, the effective flow cross-sectional area may be formed to become zero, when the differential pressure between the pressure in the crankcase S4 and the pressure in the suction chamber S1 is equal to or greater than the first pressure P1 and less than the second pressure P2, the effective flow cross-sectional area may be formed to be greater than zero and less than the first area A1, when the differential pressure between the pressure in the crankcase S4 and the pressure in the suction chamber S1 is equal to or greater than the first pressure P2 and less than a third pressure, the effective flow cross-sectional area may be formed to be the first area A1, when the differential pressure between the pressure in the crankcase S4 and the pressure in the suction chamber S1 is equal to or greater than the third pressure and less than a fourth pressure, the effective flow cross-sectional area may be formed to be less than the first area A1 and greater than the second area A2, and when the differential pressure between the pressure in the crankcase S4 and the pressure in the suction chamber S1 is equal to or greater than the fourth pressure, the effective flow cross-sectional area may be formed to be the second area A2. Here, in a range in which the differential pressure between the pressure in the crankcase S4 and the pressure in the suction chamber S1 is greater than or equal to the first pressure and less than the second pressure, the effective flow cross-sectional area of the orifice hole 460 may be increased linearly in proportion to the differential pressure between the pressure in the crankcase S4 and the pressure in the suction chamber S1. Also, in a range in which the differential pressure between the pressure in the crankcase S4 and the pressure in the suction chamber S1 is greater than or equal to the third pressure and less than the fourth pressure, the effective flow cross-sectional area of the orifice hole 460 may be decreased linearly in proportion to the differential pressure between the pressure in the crankcase S4 and the pressure in the suction chamber S1.

INDUSTRIAL APPLICABILITY

The present disclosure provides a variable displacement swash plate type compressor capable of adjusting an inclination angle of a swash plate by controlling a pressure of a crankcase equipped with a swash plate.

What is claimed is:

1. A variable displacement swash plate type compressor comprising:

a casing having a bore, a suction chamber, a discharge chamber, and a crankcase;

a rotating shaft which is supported rotatably on the casing;

a swash plate which is rotated within the crankcase in conjunction with the rotating shaft;

a piston which reciprocates within the bore in conjunction with the swash plate and forms, together with the bore, a compression chamber; and an inclination adjustment mechanism which has a first flow path which communicates the discharge chamber with the crankcase, and a second flow path which communicates the crankcase with the suction chamber, in order to adjust an inclination angle of the swash plate with respect to the rotating shaft, wherein, in the second flow path, an orifice hole which decompresses a fluid passing through the second flow path, and an orifice control mechanism which controls an effective flow cross-sectional area of the orifice hole are formed, wherein, the orifice hole and the orifice control mechanism are formed such that when a differential pressure between a pressure in the crankcase and a pressure in the suction chamber is increased, the effective flow cross-sectional area changes from zero to a first area that is larger than zero and when the differential pressure is further increased, the effective flow cross-sectional area becomes a second area that is larger than zero and less than the first area, wherein the orifice hole comprises a first orifice hole which is in communication with the crankcase, a third orifice hole which is in communication with the suction chamber, and a second orifice hole which is formed between the first orifice hole and the third orifice hole, wherein the orifice control mechanism comprises a valve chamber which is in communication with the first orifice hole and the second orifice hole, and a valve core which reciprocates along the valve chamber and controls an opening amount of the first orifice hole, an opening amount of the second orifice hole, and an opening amount of the third orifice hole, wherein the valve chamber comprises a valve chamber inner circumferential surface which guides the reciprocating motion of the valve core, a valve chamber first front end surface which is located at one end side of the valve chamber inner circumferential surface, and a valve chamber second front end surface which is located at the other end side of the valve chamber inner circumferential surface, wherein the first orifice hole is in communication with the valve chamber at the valve chamber first front end surface, wherein the second orifice hole is in communication with the valve chamber at the valve chamber second front end surface, and wherein the third orifice hole is in communication with the second orifice hole at a position facing the valve chamber, so that the first orifice hole, the valve chamber, the second orifice hole, and the third orifice hole are formed sequentially according to a direction of the reciprocating motion of the valve core.

2. The variable displacement swash plate type compressor of claim 1, wherein, the orifice hole and the orifice control mechanism are formed such that, when the differential pressure is less than a first pressure, the effective flow cross-sectional area becomes zero, when the differential pressure is greater than or equal to the first pressure and less than a second pressure, the effective flow cross-sectional area becomes the first area, and when the differential pressure is greater than or equal to the second pressure, the effective flow cross-sectional area becomes the second area.

3. The variable displacement swash plate type compressor of claim 1, wherein the valve core comprises:

a first end which reciprocates within the valve chamber and controls the opening amount of the first orifice hole; and a second end which extends from the first end and reciprocates together with the first end, and controls the opening amounts of the second orifice hole and the third orifice hole.

4. The variable displacement swash plate type compressor of claim 3, wherein the first end comprises:

a first cylindrical portion which comprises an outer circumferential surface facing the valve chamber inner circumferential surface, a bottom surface facing the second orifice hole, and an upper surface facing the third orifice hole;

a second cylindrical portion which extends from the upper surface of the first cylindrical portion to a second orifice hole side and forms a concentric circle with the first cylindrical portion; and a plurality of protrusions which are formed radially from the outer circumferential surface of the first cylindrical portion and an outer circumferential surface of the second cylindrical portion with respect to central axes of the first cylindrical portion and the second cylindrical portion, and wherein the second end comprises a third cylindrical portion which further extends from the second cylindrical portion to the second orifice hole side and forms a concentric circle with the second cylindrical portion.

5. The variable displacement swash plate type compressor of claim 4, wherein an outer diameter of the first cylindrical portion is formed to be less than an outer diameter of the plurality of protrusions, wherein an outer diameter of the second cylindrical portion is formed to be less than the outer diameter of the first cylindrical portion, wherein an outer diameter of the third cylindrical portion is formed at an equal level to the outer diameter of the second cylindrical portion, wherein an inner diameter of the valve chamber is formed at an equal level to the outer diameter of the plurality of protrusions, wherein an inner diameter of the first orifice hole is formed to be less than the outer diameter of the first cylindrical portion, wherein an inner diameter of the second orifice hole is formed to be larger than the outer diameter of the third cylindrical portion and is formed to be less than the outer diameter of the plurality of protrusions, and wherein an inner diameter of the third orifice hole is formed to be larger than the outer diameter of the third cylindrical portion and is formed to be less than the inner diameter of the second orifice hole.

6. The variable displacement swash plate type compressor of claim 5, wherein a length of the plurality of protrusions is formed to be less than a length of the valve chamber, wherein a length obtained by adding a length of the first cylindrical portion and a length of the second cylindrical portion is formed at an equal level to the length of the plurality of protrusions, wherein a length of the third cylindrical portion is formed to be larger than a length of the second orifice hole and is formed to be less than a length obtained by adding the length of the second orifice hole and a length of the third orifice hole, and wherein a length obtained by adding the length of the plurality of protrusions and the length of the third cylindrical portion is formed to be larger than the length of the valve chamber and is formed to be less than a length obtained by adding the length of the valve chamber and the length of the second orifice hole.

7. The variable displacement swash plate type compressor of claim 6, wherein an area obtained by subtracting an area of the third cylindrical portion from a cross-sectional area of the second orifice hole is formed as the first area, wherein an area obtained by subtracting the area of the third cylindrical portion from a cross-sectional area of the third orifice hole is formed as the second area, and wherein a cross-sectional area of the first orifice hole is formed to be equal to or greater than the first area.

8. The variable displacement swash plate type compressor of claim 7, wherein an area obtained by subtracting an area of the first cylindrical portion and an area of the plurality of protrusions from a cross-sectional area of the valve chamber is formed to be equal to or greater than the cross-sectional area of the first orifice hole.

9. The variable displacement swash plate type compressor of claim 1, wherein the orifice control mechanism further comprises an elastic member which presses the valve core toward the valve chamber first front end surface.

10. The variable displacement swash plate type compressor of claim 1, wherein the orifice hole and the orifice control mechanism are formed such that the effective flow cross-sectional area becomes zero when the compressor is stopped.

11. A variable displacement swash plate type compressor comprising:

a casing having a bore, a suction chamber, a discharge chamber, and a crankcase;

a rotating shaft which is supported rotatably on the casing;

a swash plate which is rotated within the crankcase in conjunction with the rotating shaft;

a piston which reciprocates within the bore in conjunction with the swash plate and forms, together with the bore, a compression chamber; and an inclination adjustment mechanism which has a first flow path which communicates the discharge chamber with the crankcase, and a second flow path which communicates the crankcase with the suction chamber, in order to adjust an inclination angle of the swash plate with respect to the rotating shaft, wherein, in the second flow path, an orifice hole which decompresses a fluid passing through the second flow path, and an orifice control mechanism which controls an effective flow cross-sectional area of the orifice hole are formed, wherein, the orifice hole and the orifice control mechanism are formed such that when a differential pressure between a pressure in the crankcase and a pressure in the suction chamber is increased, the effective flow cross-sectional area changes from zero to a first area that is larger than zero and when the differential pressure is further increased, the effective flow cross-sectional area becomes a second area that is larger than zero and less than the first area, wherein the orifice hole comprises a first orifice hole which is in communication with the crankcase, a third orifice hole which is in communication with the suction chamber, and a second orifice hole which is formed between the first orifice hole and the third orifice hole, wherein the orifice control mechanism comprises a valve chamber which is in communication with the first orifice hole and the second orifice hole, and a valve core which reciprocates along the valve chamber and controls an opening amount of the first orifice hole, an opening amount of the second orifice hole, and an opening amount of the third orifice hole, wherein the casing comprises a cylinder block in which the bore is formed, a front housing which is coupled to one side of the cylinder block and in which the crankcase is formed, and a rear housing which is coupled to the other side of the cylinder block and in which the suction chamber and the discharge chamber are formed, wherein a valve mechanism which communicates and shields the suction chamber and the discharge chamber with and from the compression chamber is interposed between the cylinder block and the rear housing, wherein the rear housing comprises a post portion which extends from an inner wall surface of the rear housing and is supported by the valve mechanism in order to prevent deformation of the rear housing, wherein the first orifice hole is formed in the valve mechanism, and wherein the valve chamber, the second orifice hole, and the third orifice hole are formed in the post portion.

* * * * *